US007020432B2

(12) United States Patent
Omata et al.

(10) Patent No.: US 7,020,432 B2
(45) **Date of Patent: *Mar. 28, 2006**

(54) RECORDING MEDIUM SUPPORTING MEMBER, RECORDING MEDIUM CONVEYING DEVICE FOR USE IN IMAGE FORMING APPARATUS AND IMAGE FORMING SYSTEM, AND IMAGE FORMING METHOD

(75) Inventors: Yasukuni Omata, Chigasaki (JP); Hideaki Mochimaru, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 72 days.

This patent is subject to a terminal disclaimer.

(21) Appl. No.: 10/769,844

(22) Filed: Feb. 3, 2004

(65) Prior Publication Data

US 2004/0156663 A1 Aug. 12, 2004

Related U.S. Application Data

(63) Continuation of application No. 10/176,672, filed on Jun. 24, 2002, now Pat. No. 6,728,505.

(30) Foreign Application Priority Data

Jun. 22, 2001 (JP) ..... 2001-189773
Mar. 22, 2002 (JP) ..... 2002-080908

(51) Int. Cl.
*G03G 15/00* (2006.01)

(52) U.S. Cl. ..... 399/400; 399/303; 399/308; 399/397

(58) Field of Classification Search ..... 399/381, 399/397, 400, 401, 402, 302, 303, 308, 309, 399/396
See application file for complete search history.

(56) References Cited

U.S. PATENT DOCUMENTS 3,697,171 A 10/1972 Sullivan
5,655,199 A 8/1997 Yamashita et al.
5,923,936 A 7/1999 Tanoue et al.

(Continued)

FOREIGN PATENT DOCUMENTS

JP 01-209470 8/1989

(Continued)

*Primary Examiner*—Hoan Tran
(74) *Attorney, Agent, or Firm*—Oblon, Spivak, McClelland, Maier & Neustadt, P.C.

(57) ABSTRACT

An image forming apparatus includes at least one image bearing member. A visual image forming device forms the visual images on the at least one image bearing member. A two-side transfer device transfers the visual images on the at least one image bearing member onto both sides of the recording medium held on a recording medium holding member. A fixing device fixes the visual images transferred onto the both sides of the recording medium. A recording medium conveying device including at least one recording medium supporting member supports the recording medium. The recording medium conveying device is positioned between the two-side transfer device and the fixing device, and conveys the recording medium from the two-side transfer device to the fixing device while supporting a non-image portion of the recording medium by the at least one recording medium supporting member.

62 Claims, 16 Drawing Sheets

U.S. PATENT DOCUMENTS

| | | | | |
|---|---|---|---|---|
| 6,067,436 | A | 5/2000 | Kohno et al. | |
| 6,133,927 | A | 10/2000 | Arai et al. | |
| 6,205,301 | B1 | 3/2001 | Shigeta et al. | |
| 6,587,667 | B1 | 7/2003 | Hauptmann | |
| 6,728,505 | B1 * | 4/2004 | Omata et al. | 399/303 |
| 6,785,508 | B1 * | 8/2004 | Jeong | 399/401 |
| 6,801,742 | B1 * | 10/2004 | Mochimaru et al. | 399/309 |

FOREIGN PATENT DOCUMENTS

| | | |
|---|---|---|
| JP | 09-211900 | 8/1997 |
| JP | 10-142869 | 5/1998 |
| JP | 10-232517 | 9/1998 |
| JP | 2000-250272 | 9/2000 |
| JP | 2001-051522 | 2/2001 |

* cited by examiner

RECORDING MEDIUM SUPPORTING MEMBER, RECORDING MEDIUM CONVEYING DEVICE FOR USE IN IMAGE FORMING APPARATUS AND IMAGE FORMING SYSTEM, AND IMAGE FORMING METHOD

CROSS-REFERENCE TO RELATED APPLICATIONS

The present application claims priority to Japanese Patent Application No. 2001-189773 filed in the Japanese Patent Office on Jun. 22, 2001, and Japanese Patent Application No. 2002-080908 filed in the Japanese Patent Office on Mar. 22, 2002, the disclosures of which are incorporated by reference herein in their entirety.

BACKGROUND OF THE INVENTION

1. Field of the Invention

The present invention relates to a recording medium supporting member, a recording medium conveying device for use in an image forming apparatus and an image forming system, and a method of forming an image on a recording medium.

2. Discussion of the Background

It is know to use image forming apparatuses that form images on both sides of a recording medium, such as a transfer sheet, by a switchback two-side transfer method.

In the switchback two-side transfer method, a visual image, such as a toner image that has been formed on an image bearing member, is transferred onto one side of a recording medium by a transfer device, and is then fixed onto the one side of the recording medium by a fixing device. The recording medium is then reversed by a reversing path, etc., and is conveyed again to the transfer device and the fixing device so that another visual image that has been formed on the image bearing member is transferred and fixed onto the other side of the recording medium.

In the above image forming apparatuses using the switchback two-side transfer method, because a switchback mechanism for reversing a recording medium to be conveyed again to the transfer device and the fixing device is necessary, the cost of the image forming apparatus may be increased. Further, it may be difficult to perform a high speed image forming operation on each side of a recording medium. Moreover, a sheet jam may tend to occur during the switchback process because a recording medium may curl when an image is fixed onto one side of the recording medium by heat.

Japanese Patent Laid-open Publications Nos. 1-209470 and 10-142869 each describe an image forming apparatus employing a one path two-side transfer method in which visual images are transferred onto both sides of a recording medium in a two-side transfer device. The recording medium is then conveyed to a fixing device, where the visual images are fixed onto both sides of the recording medium at the same time.

In the above-described image forming apparatus, because the above-described switchback mechanism and process are not necessary, the increase in cost of the apparatus and occurrence of sheet jam caused by the use of the switchback process may be avoided. Further, a high speed image formation on both sides of a recording medium may be performed.

Generally, an image forming apparatus employs a fixing device that fixes a visual image, such as a toner image, onto a recording medium, such as a transfer sheet, while heating the visual image. If such a fixing device is provided relatively close to a two-side transfer device, a visual image may be fused under the influence of heat generated from the fixing device, thereby causing image deterioration. Conversely, if such a fixing device is provided relatively apart from a two-side transfer device, it may be difficult to convey a recording medium from the two-side transfer device to the fixing device.

In order to address the above-described problems, a background image forming apparatus includes a fixing device and a two-side transfer device provided apart from each other at some distance, and a spur between the fixing device and the two-side transfer device so as to guide conveyance of a recording medium having unfixed visual images. In such a background image forming apparatus, the above-described image deterioration due to heat generated from a fixing device is prevented, and a recording medium is effectively conveyed from a two-side transfer device to a fixing device.

However, in the above-described background image forming apparatus, an unfixed visual image on a rear surface of a recording medium (i.e., a surface of a recording medium facing the spur) may be disturbed before being fixed by the fixing device due to sliding contact with the spur. Further, when an image forming substance such as a toner of an unfixed visual image is transferred to the spur from a rear surface of a recording medium due to sliding contact with the spur, the image forming substance may adhere to a succeeding recording medium, thereby adversely affecting a rear surface of the succeeding recording medium.

SUMMARY OF THE INVENTION

According to an aspect of the present invention, an image forming apparatus includes at least one image bearing member to bear visual images, a visual image forming device to form the visual images on the at least one image bearing member, and a two-side transfer device including a recording medium holding member that holds a recording medium thereon. The two-side transfer device transfers the visual images on the at least one image bearing member onto both sides of the recording medium on the recording medium holding member while moving the recording medium holding member in a predetermined direction. The image forming apparatus further includes a fixing device to fix the visual images transferred onto the both sides of the recording medium, and a recording medium conveying device including at least one recording medium supporting member that supports the recording medium. The recording medium conveying device is positioned at a recording medium conveying path between the two-side transfer device and the fixing device, and conveys the recording medium from the two-side transfer device to the fixing device while supporting a non-image portion of the recording medium by the at least one recording medium supporting member.

According to another aspect of the present invention, a method of forming an image includes forming visual images on at least one image bearing member, transferring the visual images on the at least one image bearing member onto both sides of a recording medium while moving a recording medium holding member for holding the recording medium thereon in a predetermined direction, conveying the recording medium having transferred visual images on the respective of both sides of the recording medium to a fixing device for fixing the visual images onto the recording medium while supporting a non-image portion of the recording medium, and fixing the visual images onto the recording medium.

Objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
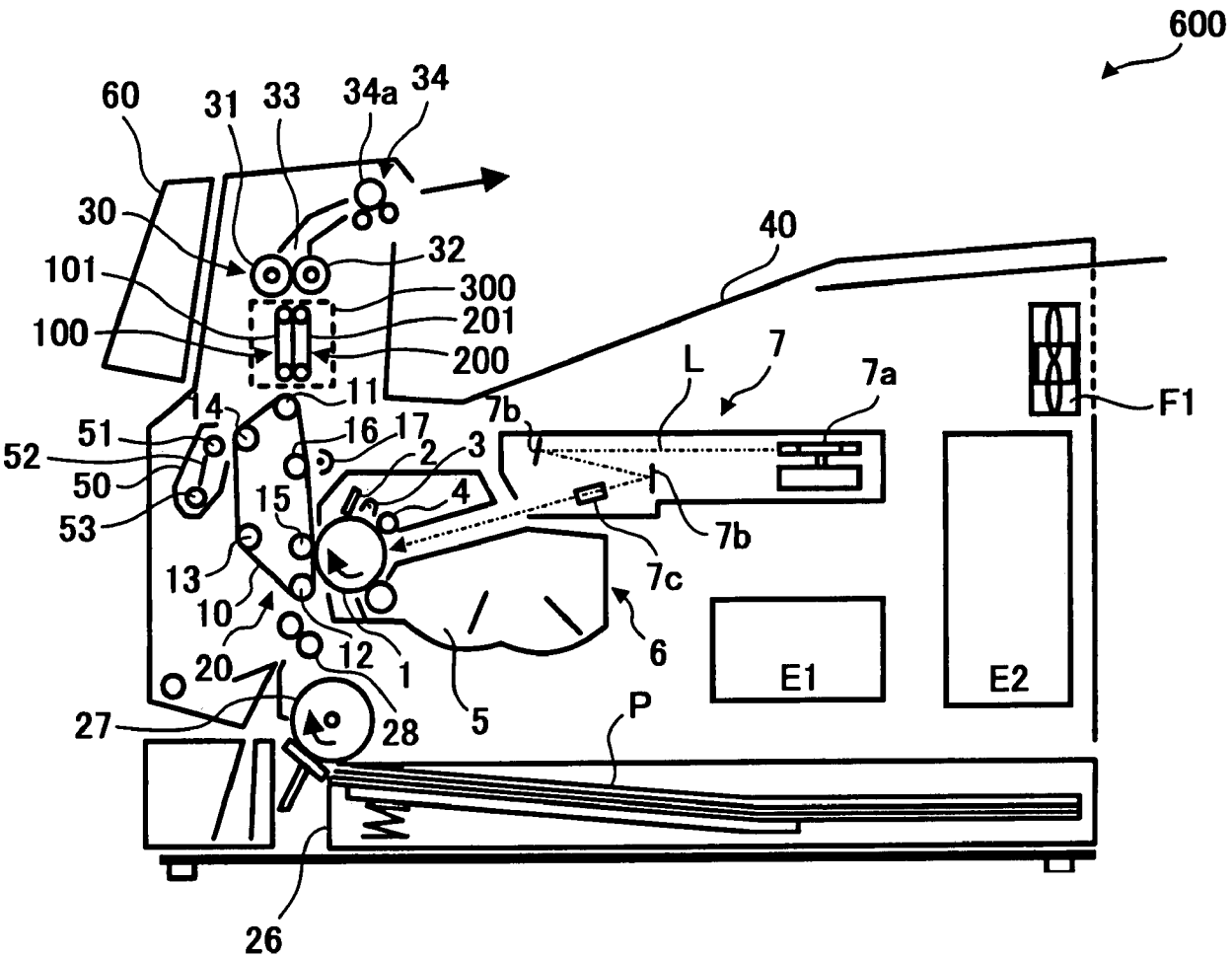
FIG. 1 is a schematic cross-sectional view of a printer as an example of an image forming apparatus according to an embodiment of the present invention.

Preferred embodiments of the present invention will now be described in detail referring to the drawings, wherein like reference numerals designate identical or corresponding parts throughout the several views.

FIG. 1 is a schematic cross-sectional view of an image forming apparatus according to the present invention. As shown in FIG. 1, the image forming apparatus can be an electrophotographic printer (printer). However, it is to be understood that the present invention is applicable to other types of image forming apparatuses.

Referring to FIG. 1, a printer 600 includes a photosensitive drum 1 serving as an image bearing member at a substantially central part of the printer 600 in a vertical direction. Arranged around the photosensitive drum 1 are a drum cleaning device 2, a discharging device 3, a charging device 4, and a developing device 5. As shown in FIG. 1, the photosensitive drum 1, the drum cleaning device 2, the discharging device 3, the charging device 4, and the developing device 5 can be integrally assembled in a process cartridge 6. The process cartridge 6 is replaced with a new one at the end of its useful lifetime.

The charging device 4 is driven to rotate in a clockwise direction in FIG. 1 by a drive device (not shown) to uniformly charge the surface of the photosensitive drum 1 with a negative polarity. The uniformly charged surface of the photosensitive drum 1 is exposed to laser light emitted from an exposure device 7, and thereby form an electrostatic latent image on the surface of the photosensitive drum 1.

The developing device 5 develops the electrostatic latent image on the photosensitive drum 1 with toner accommodated in the developing device 5 to form a toner image as a visual image. The toner image on the photosensitive drum 1 is transferred onto a sheet conveying belt 10 or a transfer sheet P by a transfer unit 20.

The drum cleaning device 2 removes excess or unnecessary toner remaining on the surface of the photosensitive drum 1 after the toner image is transferred from the photosensitive drum 1 onto the sheet conveying belt 10 or a transfer sheet P. After the drum cleaning device 2 removes residual toner from the photosensitive drum 1, the surface of the photosensitive drum 1 is uniformly discharged by the discharging device 3 in preparation for a next image forming operation.

The exposure device 7 is arranged at a right side of the process cartridge 6 in FIG. 1. A laser light (L) emitted by the exposure device 7 irradiates the photosensitive drum 1 at a writing position between the charging device 4 and the developing device 5.

Further, a sheet feeding device is arranged below the process cartridge 6 in FIG. 1. The sheet feeding device includes a sheet feeding cassette 26 as a recording medium accommodating device, a sheet feeding roller 27, and a pair of registration rollers 28. The sheet feeding cassette 26 accommodates a plurality of transfer sheets P as recording media. The sheet feeding roller 27 contacts an uppermost transfer sheet P. When the sheet feeding roller 27 is driven to rotate in a clockwise direction in FIG. 1 by a drive device (not shown), the uppermost transfer sheet P is fed to a nip part between the registration rollers 28. The transfer sheet P is further fed by the registration rollers 28 toward a transfer nip part (described in more detail below) at a predetermined timing.

The transfer unit 20 is arranged at a left side of the process cartridge 6 in FIG. 1. The transfer unit 20 includes the endless-belt shaped sheet conveying belt 10 serving as a recording medium holding member, stretch rollers 11, 12, 13, and 14, a transfer roller 15, a rear-side supporting roller 16, and a transfer charger 17. The transfer unit 20 is configured such that the sheet conveying belt 10 contacts a part of the photosensitive drum 1.

The sheet conveying belt 10 spans the stretch rollers 11, 12, 13, and 14. One of the stretch rollers 11, 12, 13, and 14 serves as a drive roller to drive the sheet conveying belt. 10 to rotate in a counterclockwise direction in FIG. 1. The one of the stretch rollers 11, 12, 13, and 14 serving as a drive roller is constructed such that a wrapping angle of the sheet conveying belt 10 is secured to effectively transmit its drive force to the sheet conveying belt 10.

The part of the sheet conveying belt 10 spanning the stretch roller 12 and the transfer roller 15 is wrapped around a part of the outer circumference of the photosensitive drum 1, thereby forming a transfer nip part. The transfer roller 15 is arranged such that the sheet conveying belt 10 is sandwiched or pressed between the photosensitive drum 1 and the transfer roller 15 at the transfer nip part. The transfer roller 15 generates a transfer electric field between the transfer roller 15 and the photosensitive drum 1 with voltage of a positive polarity applied to the transfer roller 15 from a power supply (not shown). A toner image on the photosensitive drum 1 is transferred onto the sheet conveying belt 10 or a transfer sheet P fed out from the registration rollers 28, by the transfer electric field.

Through the movement of the sheet conveying belt 10, the transfer sheet P having the toner image transferred from the photosensitive drum 1 thereonto passes through a position where the sheet conveying belt 10 opposes the transfer charger 17. The function of the transfer charger 17 is described in more detail below.

As illustrated in FIG. 1, a sheet conveying device 300 is arranged above the transfer unit 20, and a heat fixing device 30 is arranged above the sheet conveying device 300. The transfer sheet P having passed through the position where the sheet conveying belt 10 opposes the transfer charger 17 in the transfer unit 20 is conveyed to the sheet conveying device 300 from the sheet conveying belt 10, and is conveyed to the heat fixing device 30.

The heat fixing device 30 includes a heat roller 31 having a heater (not shown) disposed in an inside thereof and a pressure roller 32. The transfer sheet P fed from the sheet conveying device 300 to the heat fixing device 30 is sandwiched between the heat roller 31 and the pressure roller 32. After the toner image on the transfer sheet P is fixed by heat from the heat roller 31 and pressure between the heat roller 31 and the pressure roller 32, the transfer sheet P having a fixed toner image is-conveyed to a sheet discharging path 33. The heat roller 31 functions as a heating and sheet conveying member that heats the toner image on the transfer sheet P and conveys the transfer sheet P to the sheet discharging path 33. As compared to a fixing device in which a toner image is fixed onto a transfer sheet without being heated, a toner image is more securely fixed onto a transfer sheet P by being heated in the heat fixing device 30.

Subsequently, the transfer sheet P in the sheet discharging path 33 is discharged onto an upper surface of a main body of the printer 600 via a sheet discharging device 34 including a sheet discharging roller 34*a*. The pressure roller 32 may also serve as a heat roller having a heater inside thereof.

A sheet discharging and stacking part 40 is formed at the upper surface of the main body of the printer 600. The transfer sheet P discharged from the sheet discharging device 34 is stacked on the sheet discharging and stacking part 40 in order.

An electric unit (E1) and a control device (E2) are arranged between the sheet feeding cassette 26 and the exposure device 7 to perform an electronic control of devices in the printer 600. A fan F1 is arranged at a right upper corner of the main body of the printer 600 in FIG. 1 for forcibly discharging internal air to prevent the inside temperature from rising excessively.

The printer 600 can form images on both sides of a transfer sheet P by the following image forming process.

In the following description, an image that is formed first is referred to as a first side image, and an image that is formed later is referred to as a second side image. A sheet side onto which the first side image is transferred is referred to as a first sheet side, and a sheet side onto which the second side image is transferred is referred to as a second sheet side.

Figure 2:
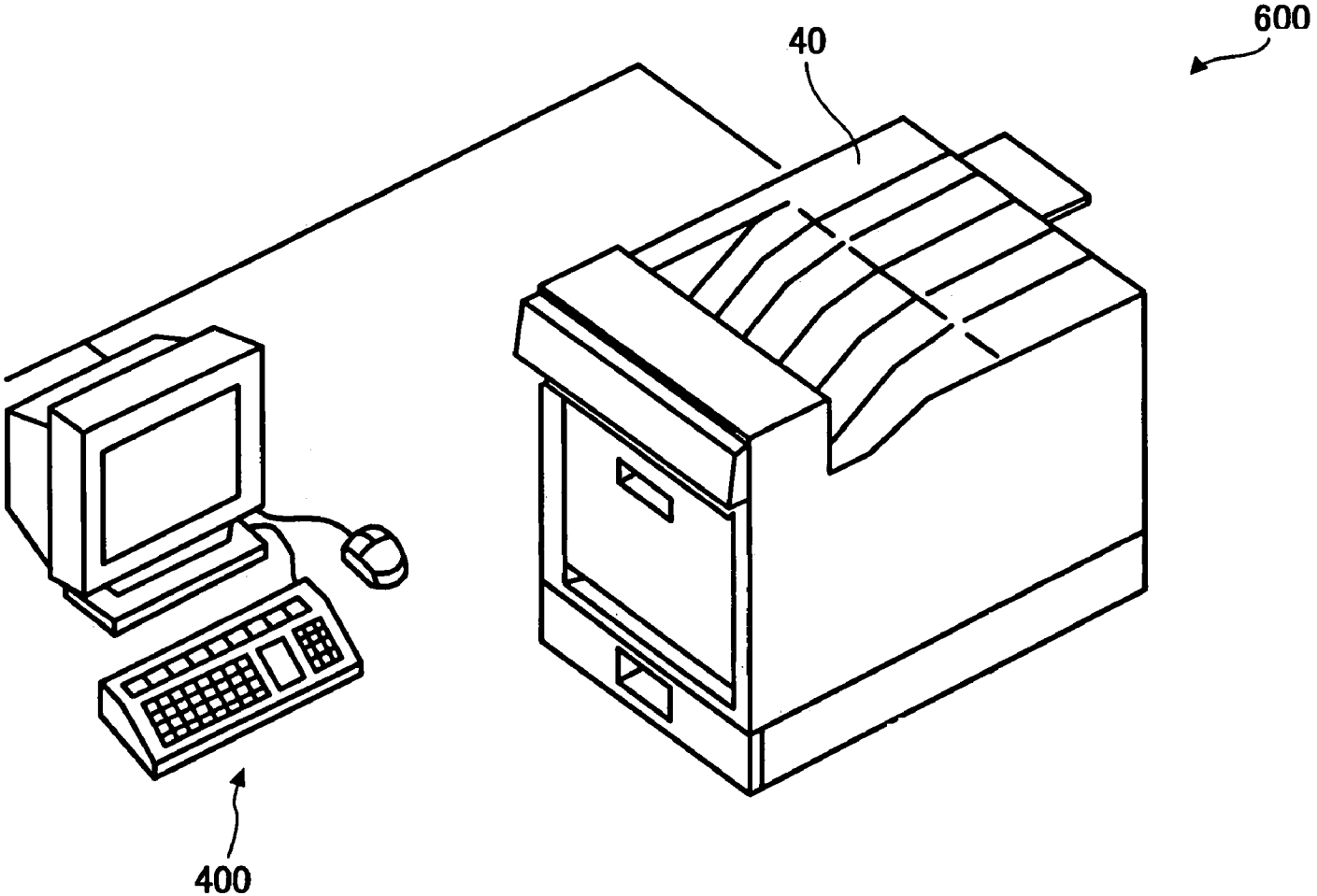
FIG. 2 is a perspective view of a personal computer and the printer of FIG. 1.

As illustrated in FIG. 2, the printer 600 forms images in accordance with a signal for writing an image that is sent from a personal computer 400 to the printer 600. The exposure device 7 is driven according to the image signal. A laser light (L) emitted from a laser light source (not shown) of the exposure device 7 is deflected so as to scan by a polygonal mirror 7*a* that is rotated by being driven by a motor (not shown). The laser light (L) is irradiated onto the photosensitive drum 1 that has been uniformly charged by the charging device 4 via mirrors 7*b*, and an fθ lens 7*c*, etc., so that an electrostatic latent image corresponding to writing information is formed on the photosensitive drum 1.

The latent image on the photosensitive drum 1 is developed with toner by the developing device 5, such that a visual image (i.e., a toner image) is formed and carried on the surface of the photosensitive drum 1 as a first side image. A first side toner image on the photosensitive drum 1 is conveyed to the above-described transfer nip part where the photosensitive drum 1 and the sheet conveying belt 10 contact each other, by rotation of the photosensitive drum 1.

At this time, a transfer sheet P is not fed to the transfer nip part. The first side toner image on the photosensitive drum 1 is not transferred onto a transfer sheet P, but rather onto the sheet conveying belt 10, which is being moved in synchronization with the rotation of the photosensitive drum 1. Subsequently, the sheet conveying belt 10 carrying the first side toner image moves one cycle and returns to the transfer nip part.

While the sheet conveying belt 10 moves one cycle, subsequent exposure and developing processes start to form a second side toner image on the photosensitive drum 1, and sheet feeding starts. A transfer sheet P is fed from the sheet feeding cassette 26 to the registration rollers 28. Further, the registration rollers 28 feed the transfer sheet P at an appropriate timing such that the first sheet side (a lower side in FIG. 1, i.e., a sheet surface opposing the sheet conveying belt 10) of the transfer sheet P and the first side toner image on the sheet conveying belt 10 that returns to the transfer nip part are correctly aligned.

The second side toner image is formed on the photosensitive drum 1 at a predetermined timing such that the second sheet side (an upper side in FIG. 1, i.e., a sheet surface opposing the photosensitive drum 1) of the transfer sheet P and the second side toner image on the photosensitive drum 1 are correctly aligned. Therefore, the transfer sheet P is sandwiched between the first side toner image on the sheet conveying belt 10 and the second side toner image on the photosensitive drum 1 at the transfer nip part.

The second side toner image on the photosensitive drum 1 is transferred onto the second sheet side of the transfer sheet P by the transfer electric field generated by the transfer roller 15. Even though the first side toner image contacts the first sheet side of the transfer sheet P, the first side toner image is not yet transferred onto the first sheet side of the transfer sheet P from the sheet conveying belt 10, because the first side toner image positioned between the sheet conveying belt 10 and the first sheet side of the transfer sheet P is attracted to the sheet conveying belt 10 by an electrostatic force generated by the transfer electric field.

After passing the transfer nip part, the transfer sheet P moves together with the sheet conveying belt 10 when the transfer sheet P carries the second side toner image transferred onto the second sheet side thereof at the transfer nip part, and the first sheet side of the transfer sheet P contacts the first side toner image on the sheet conveying belt 10. When the transfer sheet P passes a position where the transfer sheet P opposes the transfer charger 17, the first side toner image is electrostatically transferred onto the first sheet side of the transfer sheet P from the sheet conveying belt 10. Because a predetermined gap is formed between the second sheet side of the transfer sheet P and the transfer charger 17, the second side toner image on the second sheet side of the transfer sheet P is prevented from being disturbed by contact with the transfer charger 17.

As described above, the transfer unit 20 allows the first and second side toner images to be transferred onto the first and second sheet sides of the transfer sheet P, respectively, by the actions of the transfer roller 15 and the transfer charger 17. Thus, the transfer unit 20 functions as a part of a two-side transfer device that transfers toner images onto both sides of a transfer sheet P. Thus, the two-side transfer device including the transfer unit 20, a belt cleaning unit 50, etc. In the printer 600, a visual image forming device that forms visual images on the photosensitive drum 1 serving as an image bearing member the process cartridge 6, the exposure device 7, etc.

When the first side toner image on the sheet conveying belt 10 passes a charge applying position of the transfer charger 17 separate from the transfer sheet P and the second side toner image, the transfer charger 17 is controlled to be in a non-operated state.

When a mirror image is formed on the photosensitive drum 1 and the image is directly transferred onto a transfer sheet P, the image is obtained as a correct image on the transfer sheet P. When an image formed on the photosensitive drum 1 is first transferred onto the sheet conveying belt 10 and is then transferred onto a transfer sheet P, if the image is formed on the photosensitive drum 1 as a mirror image, the image is obtained on the transfer sheet P as the mirror image. Therefore, the first side toner image, which is transferred from the sheet conveying belt 10 to a transfer sheet P, is formed on the photosensitive drum 1 as a correct image, and the second side toner image, which is directly transferred from the photosensitive drum 1 onto the transfer sheet P, is formed as a mirror image on the photosensitive drum 1.

The transfer charger 17 may be arranged upstream of the transfer nip part instead of downstream of the transfer nip part in the moving direction of the sheet conveying belt 10. For example, if the polarity of the first side toner image carried on the sheet conveying belt 10 is reversed by an action of the transfer charger 17 provided at a position where the transfer charger 17 opposes the sheet conveying belt 10 between the stretch rollers 12 and 13, the first side toner image on the sheet conveying belt 10, which is positively charged, is transferred onto the transfer sheet P by electrostatic repulsion of the first toner image against the transfer roller 15 to which a positive transfer bias is applied, and the second side toner image is transferred from-the photosensitive drum 1 to the transfer sheet P by electrostatic absorption of the negatively charged second side toner image to the transfer sheet P at the transfer nip part.

Next, an image forming process of the printer 600 when obtaining an image on one side of a transfer sheet P is described. A toner image is formed on the photosensitive drum 1 as a mirror image and is moved to the transfer nip part. A transfer sheet P is fed from the sheet feeding cassette 26 to the registration rollers 28. Further, the registration rollers 28 feed the transfer sheet P to the transfer nip part at an appropriate timing such that the toner image on the photosensitive drum 1 and the transfer sheet P are correctly aligned. Thereafter, the toner image is transferred onto the transfer sheet P (an upper side in FIG. 1, i.e., a sheet surface opposing the photosensitive drum 1) at the transfer nip part. The transfer sheet P having the toner image is conveyed to the sheet conveying device 300 without charge application by the transfer charger 17.

The printer 600 employs a contact transfer method in which a toner image on the photosensitive drum 1 is transferred toward the sheet conveying belt 10 at the transfer nip part where the sheet conveying belt 10 is brought into contact with the photosensitive drum 1. As compared to a non-contact transfer method in which a transfer member (e.g., a sheet conveying belt) is separated from an image bearing member (e.g., a photosensitive drum) and a toner image jumps or traverses a gap toward the transfer member from the image bearing member, the toner image on the photosensitive drum 1 is transferred toward the sheet conveying belt 10 without traversing a gap to the sheet conveying belt 10 in the contact transfer method. Therefore, a displacement of transferred toner image due to a deviation of a toner image may be avoided in the contact transfer method.

As described above, the first side toner image, which is transferred onto the sheet conveying belt 10 from the photosensitive drum 1 at the transfer nip part, is transferred onto the first sheet side of the transfer sheet P when the first side toner image on the sheet conveying belt 10 passes the position where the sheet conveying belt 10 opposes the transfer charger 17 together with the transfer sheet P. When the transfer sheet P is separated from the sheet conveying belt 10, a quantity of toner, residual toner, from the first side toner image remains on the sheet conveying belt 10. If such residual toner on the sheet conveying belt 10 contacts a succeeding transfer sheet P fed to the transfer nip part by the registration rollers 28, the residual toner may degrade the first sheet side of the transfer sheet P.

Therefore, the printer 600 includes a belt cleaning unit 50 at a downstream position of the stretch roller 11 in the moving direction of the sheet conveying belt 10 to remove residual toner from the sheet conveying belt 10. As seen in FIG. 1, the transfer sheet P is separated from the sheet conveying belt 10 in the vicinity of the stretch roller 1l. The belt cleaning unit 50 includes a cleaning roller 51, a blade 52, a toner conveying screw 53, and a contacting/separating mechanism (not shown).

The cleaning roller 51 is configured to rotate with the sheet conveying belt 10 while sandwiching the sheet conveying belt 10 between the cleaning roller 51 and the stretch roller 14 that contacts the rear surface of the sheet conveying belt 10. The residual toner on the front surface of the sheet conveying belt 10 contacts the rotating cleaning roller 51 and then moves from the sheet conveying belt 10 to the cleaning roller 51. The toner on the cleaning roller 51 is scraped off by the blade 52 and drops on the toner conveying screw 53 arranged below the blade 52. The toner conveying screw 53 rotates and conveys the toner in the axial direction of the toner conveying screw 53 to a toner collecting device (not shown).

Figure 3A:
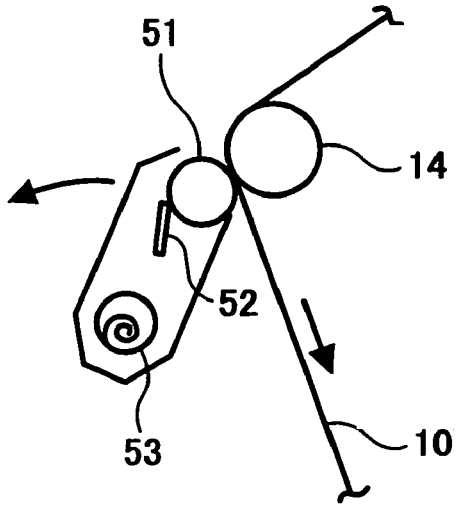
FIGS. 3A and 3B are schematic views showing a contacting/separating mechanism of a belt cleaning unit in the printer of FIG. 1.
Figure 3B:
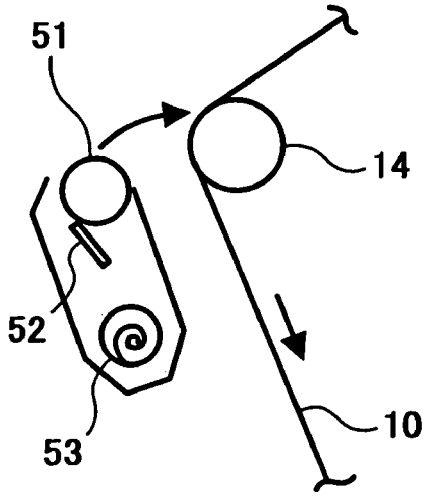

Further, a contacting/separating mechanism (not shown) is provided in the belt cleaning unit 50 to allow the cleaning roller 51 to contact and separate from the sheet conveying belt 10. The contacting/separating mechanism swings the belt cleaning unit 50 around the toner conveying screw 53, for example, by an ON/OFF operation of a solenoid (not shown). By swinging the belt cleaning unit 50, the cleaning roller 51 contacts and separates from the sheet conveying belt 10 as illustrated in FIGS. 3A and 3B.

By using the above-described contacting/separating mechanism, when the first side toner image is moved to a cleaning position, the first side toner image on the sheet conveying belt 10 may be prevented from being removed from the sheet conveying belt 10 by separating the cleaning roller 51 from the sheet conveying belt 10.

Further, by bringing the cleaning roller 51 into contact with the sheet conveying belt 10 only when cleaning is desired, and by separating the cleaning roller 51 from the sheet conveying belt 10 when the cleaning is unnecessary, loads on a rotation drive device of the cleaning roller 51 and on the sheet conveying belt 10 may be reduced. As a result, cleaning performance may be properly maintained.

Figure 4:
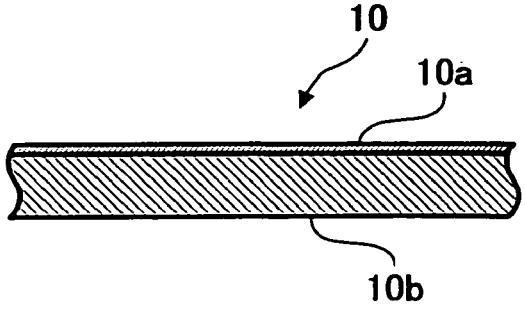
FIG. 4 is a cross-sectional view of a portion of a sheet conveying belt in a transfer unit in the printer of FIG. 1.

FIG. 4 is a cross-sectional view of a part of the sheet conveying belt 10. As illustrated in FIG. 4, the sheet conveying belt 10 has a two-layer construction. Specifically, the sheet conveying belt 10 includes a bottom layer 10*b* made of polyimide or polyamide, and a surface layer 10*a* made of fluoroplastic. By coating the bottom layer 10*b* with the surface layer 10*a* made of fluoroplastic having a low adhesive property, the surface layer 10*a* serves as a toner releasing layer. By providing the surface layer 10*a* on the bottom layer 10*b*, toner is likely to be released from the sheet conveying belt 10 when a transfer sheet P having the first side toner image is separated from the sheet conveying belt 10 and when the cleaning roller 51 removes residual toner from the sheet conveying belt 10. Further, due to the two-layer construction, an electric resistance property allowing enhanced transferring performance is more easily provided to the sheet conveying belt 10.

Figure 5:
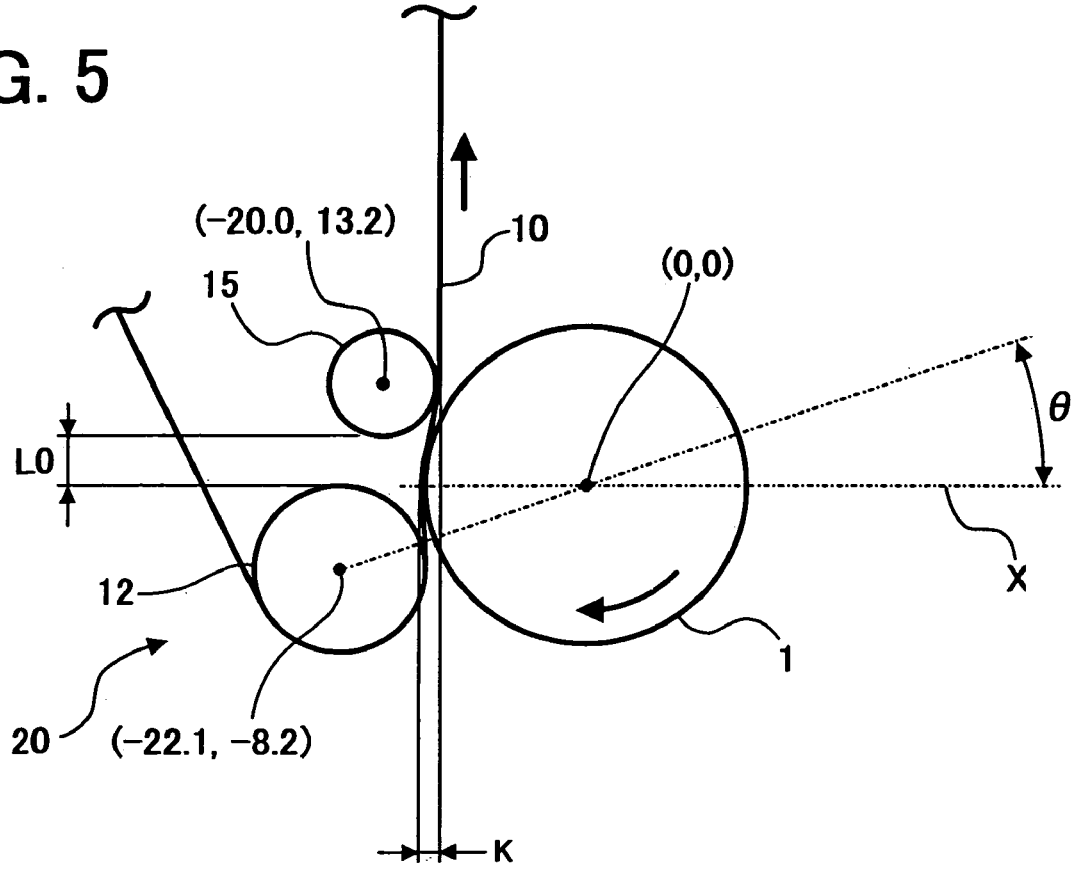
FIG. 5 is an enlarged view of a portion of the transfer unit and a photosensitive drum.

FIG. 5 is an enlarged view of the transfer unit 20 and the photosensitive drum 1. Referring to FIG. 5, the stretch roller 12 has a diameter of about 16 mm, the transfer roller 15 has a diameter of about 10 mm, and the photosensitive drum 1 has a diameter of about 30 mm.

When the coordinates of the central axis of the photosensitive drum 1 is (0, 0), the stretch roller 12 having the diameter of about 16 mm is arranged in parallel with the photosensitive drum 1 such that the central axis of the stretch roller 12 is positioned at the coordinates (−22.1, −8.2). Further, the transfer roller 15 having the diameter of about 10 mm is arranged in parallel with the photosensitive drum 1 such that the central axis of the transfer roller 15 is positioned at the coordinates (−20.0, 13.2).

The line connecting the central axis of the photosensitive drum 1 and the central axis of the stretch roller 12 and a horizontal line (X) form an angle (θ) of 20° therebetween. The arrangement position of the transfer unit 20 relative to the photosensitive drum 1 is set such that the photosensitive drum 1 is disposed in a part of the sheet conveying belt 10 spanning the stretch roller 12 and the transfer roller 15 by an intrusion amount (K) of about 0.54 mm.

In the above-described transfer unit 20, the part of the sheet conveying belt 10 spanning the stretch roller 12 and the transfer roller 15 is biased against the photosensitive drum 1 by the stretch roller 12 and the transfer roller 15. Thus, a portion of the sheet conveying belt 10 is adequately wrapped around a part of the outer circumference of the photosensitive drum 1. The sheet conveying belt 10 is wrapped around about one-tenth of the peripheral length of the photosensitive drum 1, thereby forming a transfer nip part having a width of about 8.7 mm. In the case of forming such a transfer nip part, as compared to a point contact of the photosensitive drum 1 and the sheet conveying belt 10 at the transfer position, the photosensitive drum 1 and the sheet conveying belt 10 securely contact each other at the transfer position, so that occurrence of blurring of a toner image transferred from the photosensitive drum 1 onto the sheet conveying belt 10 or a transfer sheet P due to unstable contact condition of the photosensitive drum 1 and the sheet conveying belt 10 at the transfer position may be prevented.

With respect to the stretch roller 12 and the transfer roller 15 which form the transfer nip part, respective materials, cross-sections, lengths, and diameters of the stretch roller 12 and the transfer roller 15 are preferably determined such that flexibilities of the stretch roller 12 and the transfer roller 15 caused by the tension of the sheet conveying belt 10 are limited to 0.5 mm or less.

Specifically, each flexibility amount "y" (mm) of the stretch roller 12 and the transfer roller 15 is obtained by the following calculation:

$$y=-(5WL^4)/(384EI),$$

where "W" (kg/mm) is weight per unit length, "L" (mm) is a length of a part of each roller where weight is applied by the sheet conveying belt 10, "E" (kg/mm$^2$) is Young's modulus, and "I" (mm$^4$) is geometrical moment of inertia.

The length "L" of the part of each roller where weight is applied by the sheet conveying belt 10 and the geometrical moment of inertia "I" are preferably determined such that the flexibility amount "y" of each roller is limited to 0.5 mm or less. Further, a material of each roller is preferably determined such that the Young's modulus "E" and the weight per unit length "W" allow the flexibility "y" of each roller to be 0.5 mm or less.

By limiting the flexibility "y" of the stretch roller 12 and the transfer roller 15 to 0.5 mm or less, wandering of the sheet conveying-belt 10 at the transfer nip part may be prevented.

The geometrical moment of inertia "I" is obtained by the following calculation:

$$I=\pi(D1^4-D2^4)/64,$$

where D1 is an outer diameter of a roller and D2 is an inner diameter of a roller.

In this embodiment, the printer 600 can employ a transfer roller 15 that is a conductive solid (i.e., not hollow) roller made of stainless steel and having a diameter of about 10 mm. By use of such a transfer roller 15, the flexibility "y" of the transfer roller 15 is limited to 0.5 mm or less. In addition, because the transfer roller 15 is a metallic roller having a high durability, the transfer roller 15 may perform a stable electrostatic transferring of an image during a longer period of time than a roller made of conductive rubber, for example. Further, the printer 600 can employ a stretch roller 12 that is a solid roller made of stainless steel and having a diameter of about 16 mm. By use of such a stretch roller 12, the flexibility "y" of the stretch roller 12 is limited to 0.5 mm or less.

Further, the charging of the stretch roller 12 due to friction between the sheet conveying belt 10 and the stretch roller 12 is prevented by grounding the stretch roller 12. In this embodiment, a transfer bias of 7 kV or less can be applied to the transfer roller 15. In this condition, an electric discharge between the transfer roller 15 and the stretch roller 12 is prevented by separating the transfer roller 15 from the stretch roller 12 by a distance (L0) in FIG. 5 of about 5 mm or more. Particularly, the distance (L0) can be about 7 mm.

Figure 6:
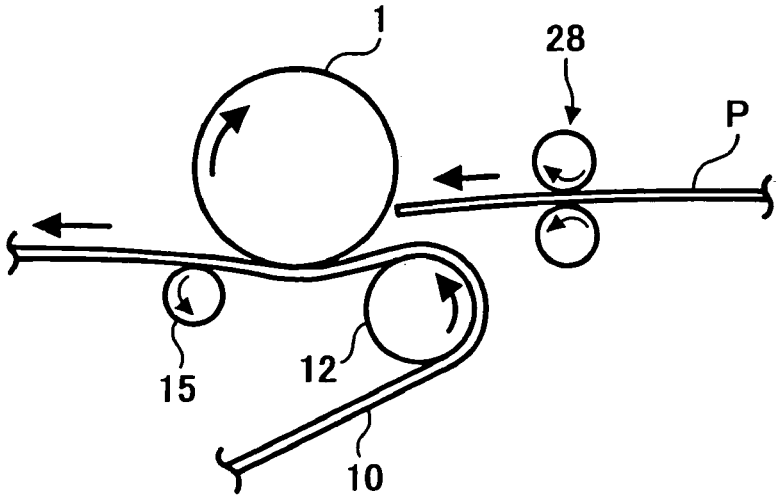
FIG. 6 is a schematic view of a pair of registration rollers and a transfer nip part between the photosensitive drum and a sheet conveying belt in the printer of FIG. 1.

FIG. 6 is a schematic view of the registration rollers 28 and the transfer nip part between the photosensitive drum 1 and the sheet conveying belt 10. The registration rollers 28 are arranged at a position such that a leading edge of a transfer sheet P fed from the sheet feeding cassette 26 contacts the photosensitive drum 1 before contacting the sheet conveying belt 10. In such an arrangement of the registration rollers 28, as compared to a case in which a leading edge of a transfer sheet P fed from the sheet feeding cassette 26 contacts the sheet conveying belt 10 before contacting the photosensitive drum 1, a toner image may be properly transferred from the photosensitive drum 1 to the transfer sheet P.

Figure 7A:
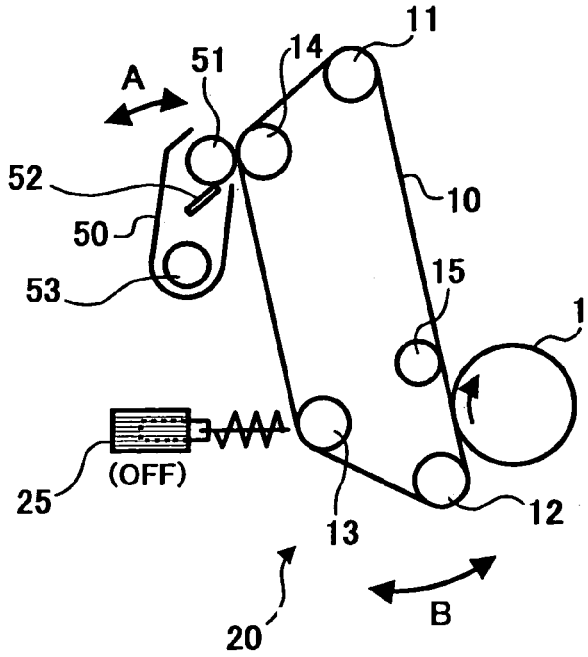
FIGS. 7A and 7B are schematic views showing a contacting/separating mechanism of the transfer unit in the printer of FIG. 1.
Figure 7B:
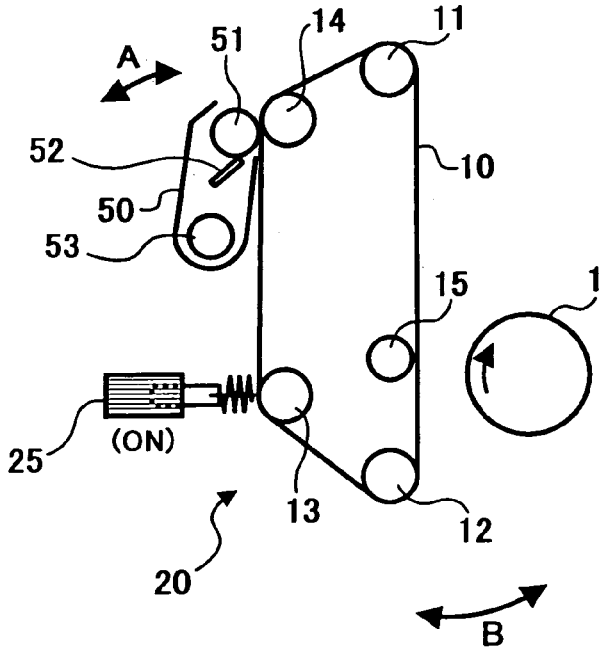

As shown in FIGS. 7A and 7B, the above-described transfer unit 20 includes a solenoid 25 serving as a contacting/separating device that contacts and separates the transfer unit 20 with and from the photosensitive drum 1. The stretch roller 11 of the transfer unit 20 is a drive roller that drives the sheet conveying belt 10 to rotate. The transfer unit 20 swings around the stretch roller 11 in a direction indicated by a double-headed arrow (B) by an ON/OFF operation of the solenoid 25.

As described above, the belt cleaning unit 50 arranged at a position where the sheet conveying belt 10 is sandwiched between the belt cleaning unit 50 and the stretch roller 14 in the transfer unit 20 swings around the toner conveying screw 53 in a direction indicated by a double-headed arrow (A) in FIGS. 7A and 7B.

When the transfer unit 20 is swung leftward in FIG. 7B around the stretch roller 11 by turning on the solenoid 25, the belt cleaning unit 50 is biased by the stretch roller 14, and thereby the belt cleaning unit 50 is inclined leftward in FIG. 7B around the toner conveying screw 53. When the transfer unit 20 and the belt cleaning unit 50 are swung and inclined as described above, the sheet conveying belt 10 is separated from the photosensitive drum 1. As a result, the transfer nip part does not exist between the photosensitive drum 1 and the sheet conveying belt 10 as illustrated in FIG. 7B.

Conversely, by turning off the solenoid 25, the transfer unit 20 is swung rightward in FIG. 7A around the stretch roller 11. At substantially the same time, the belt cleaning unit 50 is swung rightward in FIG. 7A around the toner conveying screw 53. The sheet conveying belt 10 contacts the photosensitive drum 1 as illustrated in FIG. 7A.

As described above, in the printer 600 according to the present embodiment, the sheet conveying belt 10 can be separated from the photosensitive drum 1 by the contacting/separating device. Therefore, loads on the sheet conveying belt 10 and the photosensitive drum 1 may be reduced, and the transfer performance of the transfer unit 20 may be properly maintained. Further, a foreign substance clogged in the transfer nip part may be easily removed.

It is preferable that the sheet conveying belt 10 be brought into contact with the photosensitive drum 1 during at least a period of time in which the first side toner image and the second side toner image on the photosensitive drum 1 pass a position where the first side toner image and the second side toner image oppose the sheet conveying belt 10 by rotation of the photosensitive drum 1. By contacting the sheet conveying belt 10 and the photosensitive drum 1 during the above-described period of time, the first side toner image and the second side toner image on the photosensitive drum 1 may enter the transfer nip part.

It is more preferable that a contact condition of the sheet conveying belt 10 and the photosensitive drum 1 be maintained during a period of time in which exposure and developing processes are performed on the photosensitive drum 1 in addition to the above-described period of time. Then, toner images are not disturbed by vibrations caused by contacting and separating the sheet conveying belt 10 from the photosensitive drum 1 in the processes of exposure and developing. As a result, image blurring is prevented.

It is still more preferable that a sheet jam detecting device be provided to detect an occurrence of sheet jam in a sheet conveying path from the sheet feeding cassette 26 to the sheet discharging and stacking part 40. When the sheet jam detecting device detects an occurrence of sheet jam, the sheet conveying belt 10 is separated from the photosensitive drum 1.

As an example of the sheet jam detecting device, a sheet detecting sensor such as a photosensor may be provided in the vicinity of the sheet discharging device 34. When the sheet detecting sensor does not detect a transfer sheet P after a predetermined time has elapsed from when the sheet feeding roller 27 feeds the transfer sheet P, it is determined that a sheet jam occurs in a sheet conveying path. Even if a transfer sheet P is jammed in the transfer nip part, the transfer sheet P may be easily removed from the sheet conveying path by separating the sheet conveying belt 10 from the photosensitive drum 1 based on a detection output of the sheet jam detecting device.

Next, description is made with respect to features of the construction of the printer 600.

A background image forming apparatus does not include a sheet conveying device like the sheet conveying device 300 illustrated in FIG. 1. Therefore, in the background image forming apparatus, a transfer sheet is directly conveyed from a two-side transfer device to a heat fixing device, or a transfer sheet is conveyed from a two-side transfer device to a heat fixing device via a guide mechanism such as a guide plate and a spur. In the case that a transfer sheet is directly conveyed from a two-side transfer device to a heat fixing device, the heat fixing device needs to be provided relatively close to the two-side transfer device, thereby causing image deterioration due to heat generated from the heat fixing device. Further, in the case that a transfer sheet is conveyed from a two-side transfer device to a heat fixing device via a guide mechanism, an unfixed toner image on a rear surface of a transfer sheet (i.e., a surface of a transfer sheet facing the guide mechanism) may be disturbed before being fixed by the heat fixing device due to sliding contact with the guide mechanism.

In the printer 600, as illustrated in FIG. 1, the sheet conveying device 300 is arranged between the transfer unit 20 and the heat fixing device 30. Specifically, the sheet conveying device 300 is positioned between the two-side transfer device including the transfer unit 20 and the belt cleaning unit 50, and the heat fixing device 30. The sheet conveying device 300 conveys a transfer sheet P fed from the transfer unit 20, toward the heat fixing device 30 while holding the transfer sheet P between a pair of belt pair units. The pair of belt pair units include a first belt pair unit 100 in which an endless belt is moved in a counter-clockwise direction in FIG. 1, and a second belt pair unit 200 in which an endless belt is moved in a clockwise direction in FIG. 1.

Figure 8:
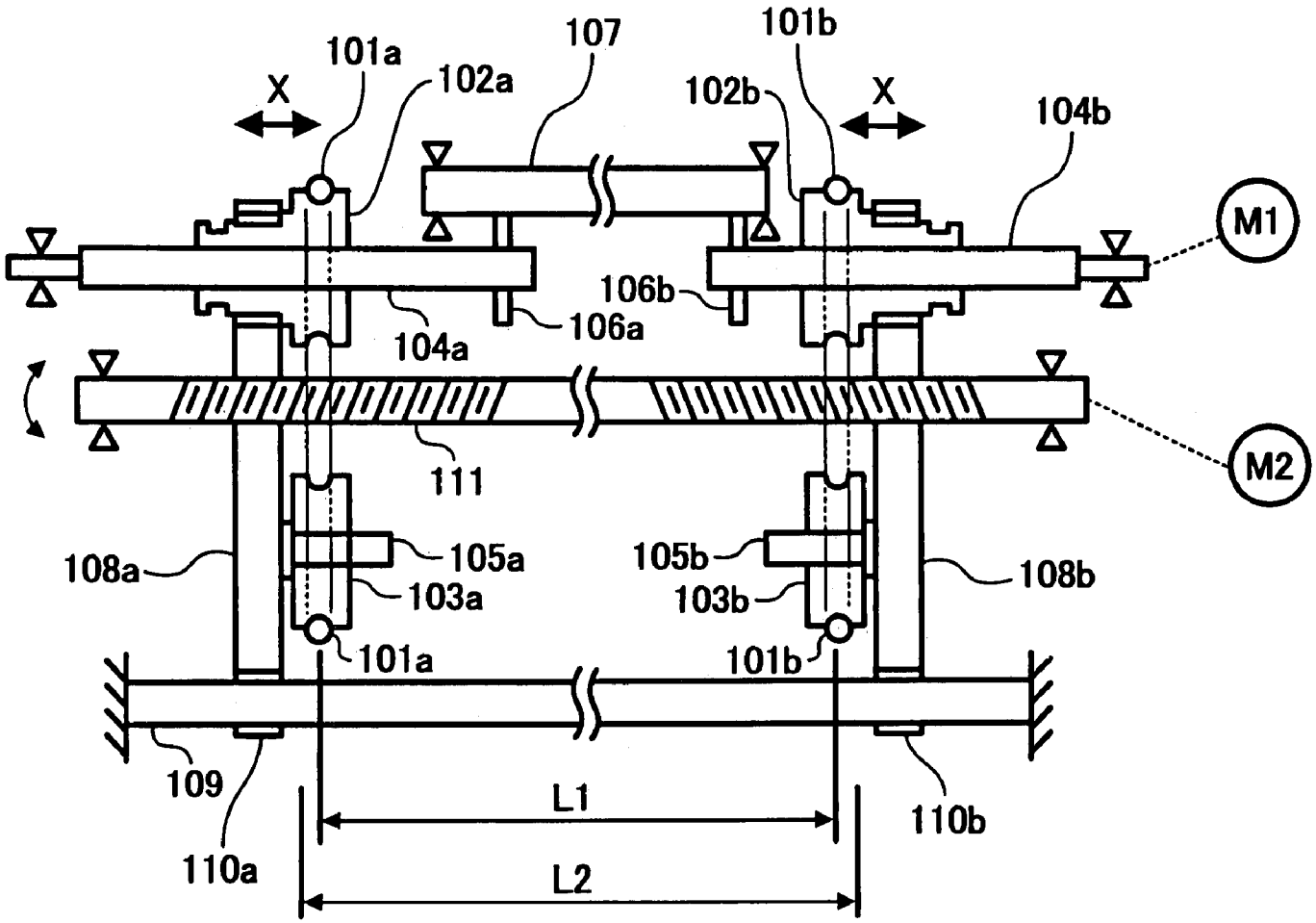
FIG. 8 is a front view of a first belt pair unit in a sheet conveying device in the printer of FIG. 1.
Figure 9:
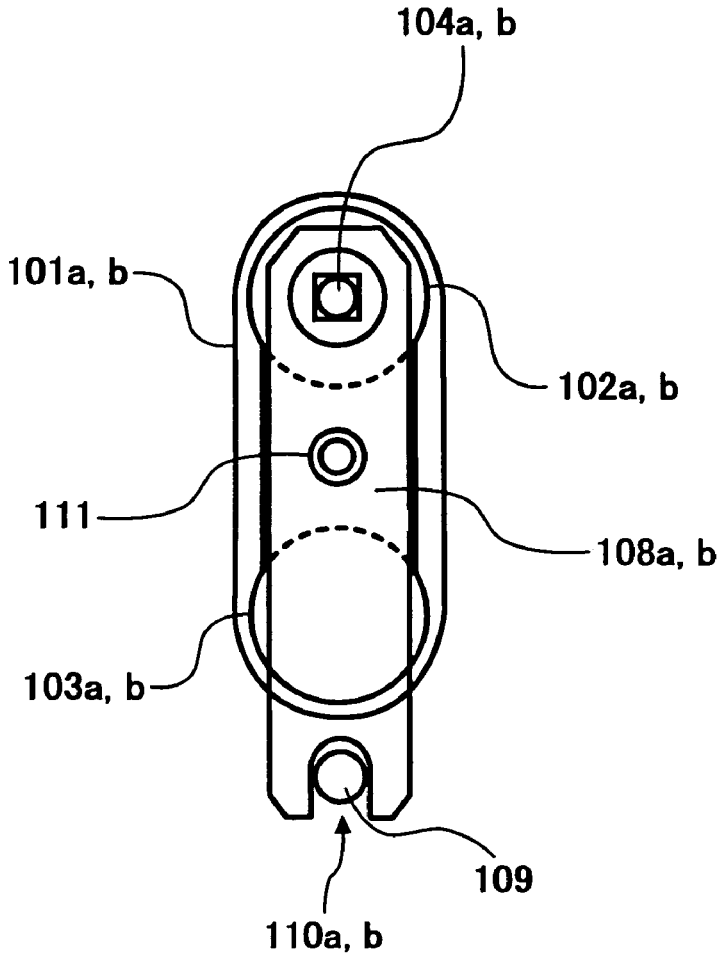
FIG. 9 is a side view of the first belt pair unit.

FIG. 8 is a front view of the first belt pair unit 100 in the sheet conveying device 300. FIG. 9 is a side view of the first belt pair unit 100. Referring to FIGS. 8 and 9, the first belt pair unit 100, which constructs a sheet conveying path together with the second belt pair unit 200 (not shown), includes endless belts 101*a* and 101*b* functioning as recording medium supporting members. The belt 101*a* is moved in contact with the vicinity of one side end portion of the first sheet side of a transfer sheet. The belt 101*b* is moved in contact with-the vicinity of the other side end portion of the first sheet side of the transfer sheet.

A moving mechanism for moving the belt 101*a* is formed in the vicinity of one side end part of the first belt pair unit 100. Specifically, the belt 101*a* spans around a groove portion formed in a peripheral surface of a drive pulley 102*a* and a groove portion formed in a peripheral surface of a driven pulley 103*a*. The belt 101*a* is driven to move by rotation of the drive pulley 102*a*. The drive pulley 102*a* and the driven pulley 103*a* are rotated around shaft members 104*a*, 105*a*, respectively, each of which is rotatably supported by a side plate 108*a*.

Further, a similar moving mechanism for moving the belt 101*b* is formed in the vicinity of the other side end part of the first belt pair unit 100 by the belt 101*b*, a drive pulley 102*b*, a driven pulley 103*b*, a side plate 108*b*, shaft members 104*b*, 105*b*, etc. Long hole-shaped recesses 110*a*, 110*b* are formed with the side plates 108*a*, 108*b*, respectively, at their tail end portions. A shaft 109 is engaged with the long hole-shaped recesses 110*a*, 110*b*, thereby coupling the side plates 108*a*, 108*b* each other. Further, a screw shaft 111 is engaged with openings for female screws respectively provided in the vicinity of central portions of the side plates 108*a*, 108*b*, thereby similarly coupling the side plates 108*a*, 108*b* with each other.

As illustrated in FIG. 8, screw-shaped protrusions are formed with the circumferential surface of the screw shaft 111 such that the screw-shaped protrusions are symmetrically inclined about a center part of the screw shaft 111. Further, the vicinities of both end portions of the screw shaft 111 are rotatably supported by respective bearings, and one side end portion of the screw shaft 111 is connected to a motor (M2) via a gear (not shown).

When rotating the motor (M2) in a forward direction, the side plate 108*a* at the left side as viewed in FIG. 8 slides rightward and the side plate 108*b* at the right side as viewed in FIG. 8 slides leftward by screwing the screw-shaped protrusions into the openings for female screws. The shaft 109 guides the side plates 108*a*, 108*b* to slide. As a result of the slides of the side plates 108*a*, 108*b*, a distance (L1) between the belts 101*a* and 101*b* is decreased.

When rotating the motor (M2) in a reverse direction, the side plate 108*a* at the left side as viewed in FIG. 8 slides leftward and the side plate 108*b* at the right side as viewed in FIG. 8 slides rightward, thereby increasing the distance (L1).

The vicinity of one side end portion (i.e., the vicinity of right side end portion as viewed in FIG. 8) of the shaft member 104*b*, which is a rotation center of the drive pulley 102*b* positioned at the right side in FIG. 8, is rotatably supported by a bearing, and is connected to a motor (N1) serving as a drive device via a gear (not shown). The drive force of the motor (M1) is transmitted to the shaft member 104*b* via the gear, thereby rotating the drive pulley 102*b*.

A gear 106*b* is provided in the vicinity of the other side end portion (i.e., the left side end portion as viewed in FIG. 8) of the shaft member 104*b*. Above the gear 106*b*, an extended shaft gear 107 is engaged with the gear 106*b*.

A gear 106*a* is provided in the vicinity of one side end portion (i.e., the right side end portion as viewed in FIG. 8) of the shaft member 104*a* which is a rotation center of the drive pulley 102*a* positioned at the left side in FIG. 8. The extended shaft gear 107 is similarly engaged with the gear 106*a* while the vicinities of both end portions of the extended shaft gear 107 are rotatably supported.

When rotating the shaft member 104*b* at the right side in FIG. 8 by the motor (M1), the drive force of the motor (M1) is transmitted to the shaft member 104*a* at the left side in FIG. 8 via the gear 106*b*, the extended shaft gear 107, and the gear 106*a*. Thereby, irrespective of the distance (L1), the drive pulleys 102*a* and 102*b* are rotated in synchronization with each other. With the rotations of the drive pulleys 102*a* and 102*b*, the belts 101*a* and 101*b* are moved in synchronization with each other.

Figure 10:
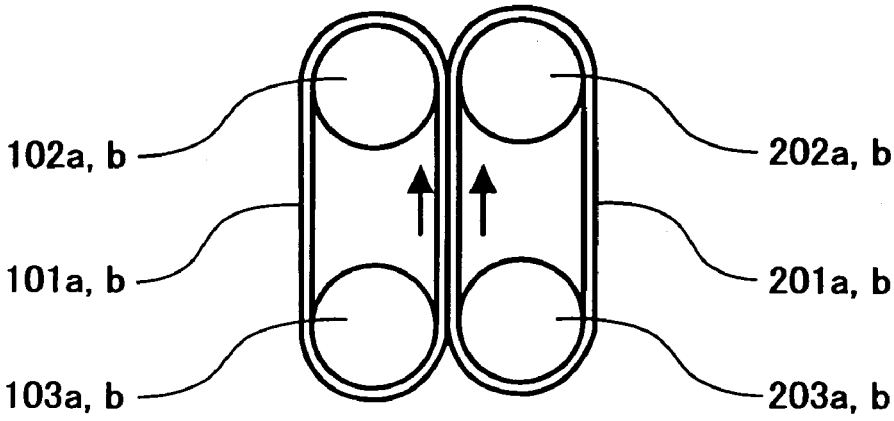
FIG. 10 is an enlarged side view of the sheet conveying device.

The second belt pair unit 200 in the sheet conveying device 300 has a construction similar to the first belt pair unit 100. As illustrated in FIG. 10, in the first belt pair unit 100 and the second belt pair unit 200, the belt 101*a* and the belt 201*a* are moved in contact with each other in the forward direction. Specifically, as illustrated in FIG. 10, the belt 101*a* is moved in the counter-clockwise direction in contact with the belt 201 a moved in the clockwise direction.

Likewise, the belt 101*b* in the first belt pair unit 100 and the belt 201*b* in the second belt pair unit 200 are moved in contact with each other in the forward direction. The belts 201*a* and 201*b* in the second belt pair unit 200 are also moved by rotation of the motor (M1) illustrated in FIG. 8. Further, a distance between the belts 201*a* and 201*b* in the second belt pair unit 200 is also adjusted by rotation of the motor (M2) illustrated in FIG. 8. As described above, a distance changing mechanism that adjusts the distance between the belts 101*a* and 101*b* and the distance between the belts 201*a* and 201*b* is included in the sheet conveying device 300. The motor (M1) is exclusively used for driving each belt in the sheet conveying device 300.

Referring to FIG. 8, a reference character (L2) represents a distance between outer side surfaces of the drive pulleys 101*a* and 101*b*. The distance (L2) is set to be substantially the same as a width of a transfer sheet P. In the sheet conveying device 300, the vicinity of one side end portion of a transfer sheet P in the sheet width direction is sandwiched between the belt 101*a* in the first belt pair unit 100 and the belt 201*a* in the second belt pair unit 200, and the vicinity of the other side end portion of the transfer sheet P in the sheet width direction is sandwiched between the belt 101*b* in the first belt pair unit 100 and the belt 201*b* in the second belt pair unit 200. The sheet conveying device 300 holds the transfer sheet P by sandwiching the end portions of the transfer sheet P between the belts (101*a*/201*a*, 101*b*/201*b*), and conveys the transfer sheet P toward the heat fixing device 30 by moving the belts 101*a*, 101*b*, 201*a*, 201*b*.

With the above-described construction of the sheet conveying device 300, the sheet conveying device 300 conveys a transfer sheet P from the transfer unit 20 to the heat fixing device 30 while the belts 101*a*, 101*b*, 201*a*, 201*b*, contact only both end portions of the transfer sheet P in the sheet width direction. Generally, an image is formed on a transfer sheet P having respective margins at both end portions thereof. Each of the margins has a predetermined width and corresponds to a non-image portion of the transfer sheet P. In the sheet conveying device 300, each of belts 101*a*, 101*b*, 201*a*, 201*b*, conveys the transfer sheet P while contacting only the margin of the transfer sheet P, thereby preventing an unfixed toner image on the transfer sheet P from being disturbed by contact of the belts with the unfixed toner image. Further, a succeeding transfer sheet P is prevented from being degraded by the toner adhered onto belts when the belts contact an unfixed toner image on a preceding transfer sheet P.

As compared to a sheet conveying device including a gripping member reciprocating mechanism that reciprocates a gripping member for gripping both ends of a transfer sheet between a transfer unit and a heat fixing device, the sheet conveying device 300 conveys a transfer sheet P from the transfer unit 20 to the heat fixing device 30 with a simple construction. Further, the sheet conveying device 300 includes the motor (M1) exclusively used as a driving device that drives the first belt pair unit 100 and the second belt pair unit 200. Because the load fluctuation on the motor (M1) at the time of starting and stopping devices such as a photosensitive drum 1, does not occur, the belts 101*a*, 101*b*, 201*a*, 201*b* can be driven at a stable speed, so that an influence on a toner image due to the speed fluctuation of the first belt pair unit 100 and the second belt pair unit 200 can be limited.

Referring back to FIG. 1, when the sheet conveying device 300 conveys a transfer sheet P from the transfer unit 20 to the heat fixing device 30, the transfer sheet P is conveyed from a lower side to an upper side in a substantially vertical direction. As illustrated in FIG. 1, the heat fixing device 30 including a heat source can be positioned at an upper part of the main body of the printer 600. As a result, heat generated from the heat fixing device 30 can be discharged outside of the case of the printer 600, thereby preventing heat from building up within the case.

As described above, the printer 600 includes the sheet conveying device 300 having a sheet conveying ability to convey a transfer sheet P by moving the belts 101*a*, 101*b*, 201*a*, 201*b* that sandwich the transfer sheet P between the belts 101*a* and 201*a*, and between the belts 101*b* and 201*b*. Instead of the sheet conveying device 300, a both end guide member (not shown) that does not have a sheet conveying ability and supports a transfer sheet P by both ends of the both end guide member may be used. In the case of using such a both end guide member, because the both end guide member does not have a sheet conveying ability, a sheet conveyance needs to depend on the transfer unit 20 and the heat fixing device 30. Therefore, the transfer unit 20 and the heat fixing device 30 are not separated from each other by a distance more than a length of a transfer sheet P. In the case of using the sheet conveying device 300, because the sheet conveying device 300 has a sheet conveying ability, the transfer unit 20 and the heat fixing device 30 can be separated from each other by a distance more than a length of a transfer sheet P.

In this embodiment, the sheet conveying device 300 supports both end portions of a transfer sheet P corresponding to non-image portions. As another example of supporting non-image portions of a transfer sheet P, non-image portions of a transfer sheet P are searched by a non-image portion detecting device that detects non-image portions of a transfer sheet P, and are supported by a recording medium supporting member such as a suction nozzle. However, the non-image portion detecting device and a moving mechanism for moving the recording medium supporting member to arbitrary positions can be used, resulting in a more complicated construction.

Instead of supporting non-image portions at both end portions of a transfer sheet P in a sheet width direction (i.e., a direction perpendicular to a sheet conveying direction), non-image portions at leading and trailing edge portions of a transfer sheet P in a sheet length direction (i.e., a sheet conveying direction) may be supported. However, in this case, a mechanism for conveying forward a transfer sheet P whose leading and trailing edge portions are supported can be used, resulting in a more complicated construction.

In the sheet conveying device 300, a transfer sheet P is supported by sandwiching both end portions of a transfer sheet P in a sheet width direction between the belts 101*a* and 201*a*, and between the belts 101*b* and 201*b*. As compared to a case in which a transfer sheet P is supported only from lower side in the gravity direction, a transfer sheet P is prevented from dropping from a recording medium supporting member by influence of gravity, and a position of the transfer sheet P is prevented from being displaced in the sheet conveying device 300.

Figure 11:
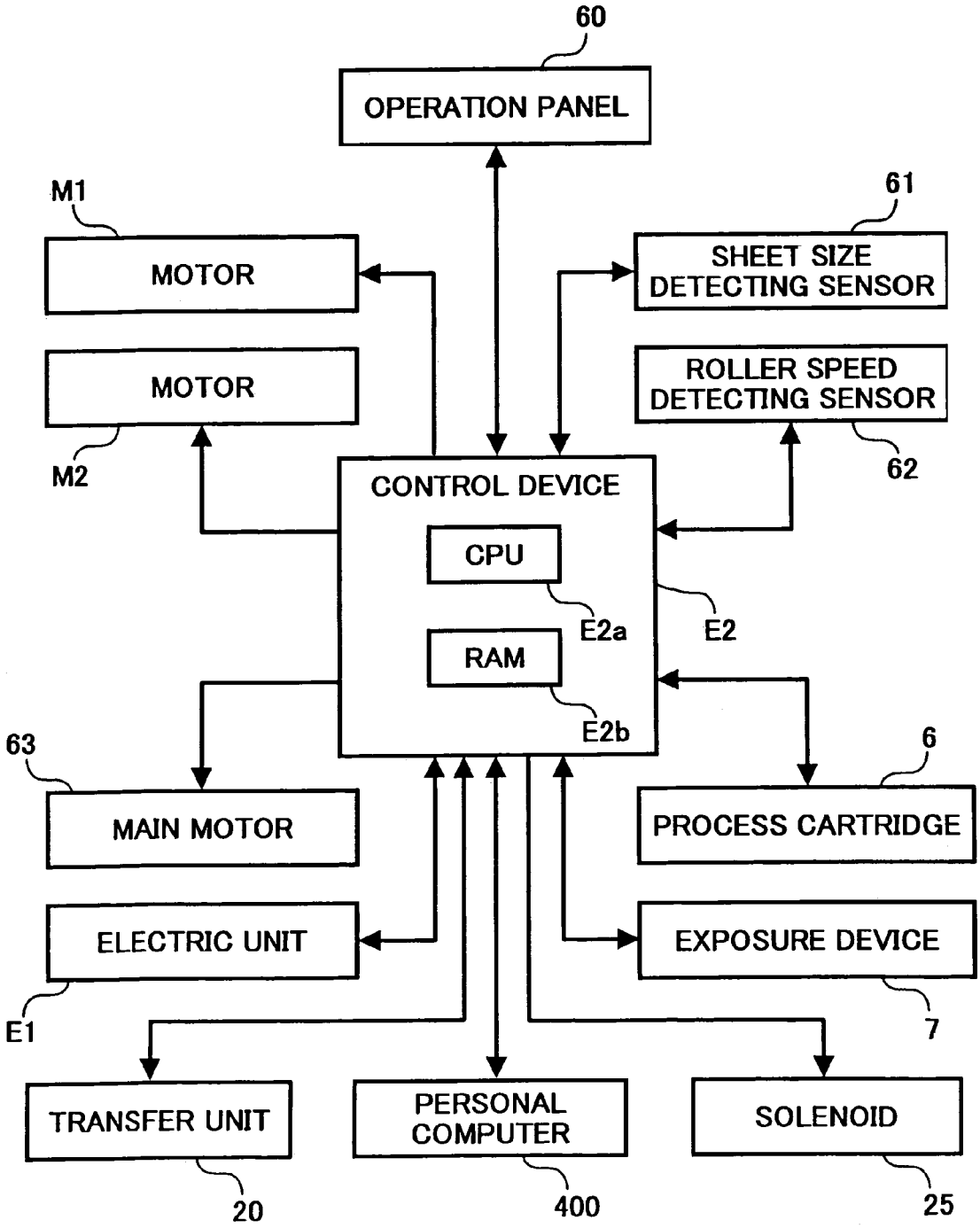
FIG. 11 is a block diagram illustrating a portion of an electric circuit used in the printer of FIG. 1.

FIG. 11 is a block diagram illustrating an electric circuit used for the printer 600. Referring to FIG. 11, the control device (E2) includes a central processing unit (CPU) (E2*a*), a random-access memory (RAM) (E2*b*) as a memory device. The control device (E2) is connected to the motor (M1), the motor (M2), an operation panel 60, a sheet size detecting sensor 61, a roller speed detecting sensor 62, the process cartridge 6, the exposure device 7, the solenoid 25, the personal computer 400, the transfer unit 20, the electric unit (E1), a main motor 63, etc. In addition, an input/output unit (not shown) is connected to the control device (E2) to communicate signals to the personal computer 400.

The operation panel 60 receives operational instructions from an operator and transmits instruction signals corresponding to the operational instructions to the control device (E2). The operation panel 60 includes a display lamp that displays the condition and status of the printer 600, a display part including a liquid crystal display, and an operation part including key buttons. As illustrated in FIG. 1, the operation panel 60 is fixed on a front panel of the case of the main body of the printer 600.

The sheet size detecting sensor 61 serving as a sheet size detecting device detects a size of a transfer sheet P accommodated in the sheet feeding cassette 26 or set on a manual sheet feeding tray (not shown). The roller speed detecting sensor 62 includes, for example, a photosensor, to detect a surface moving speed of the heat roller 31 of the heat fixing device 30 illustrated in FIG. 1. The main motor 63 transmits a driving force to the photosensitive drum 1, the developing device 5, etc.

Because the operation panel 60 is provided with a front side plate of the main body of the printer 600 as illustrated in FIG. 1, a data input to the control device E2 is implemented without causing an operator to be inconvenienced by opening the case to expose the control device E2. Therefore, the operator can easily input a parameter for setting the distance (L1) between the belts 101*a*, 101*b* and between the belts 201*a*, 201*b*, for example, a numeric value of a percentage of a sheet width, and various parameters are stored in the control device (E2).

Figure 12:
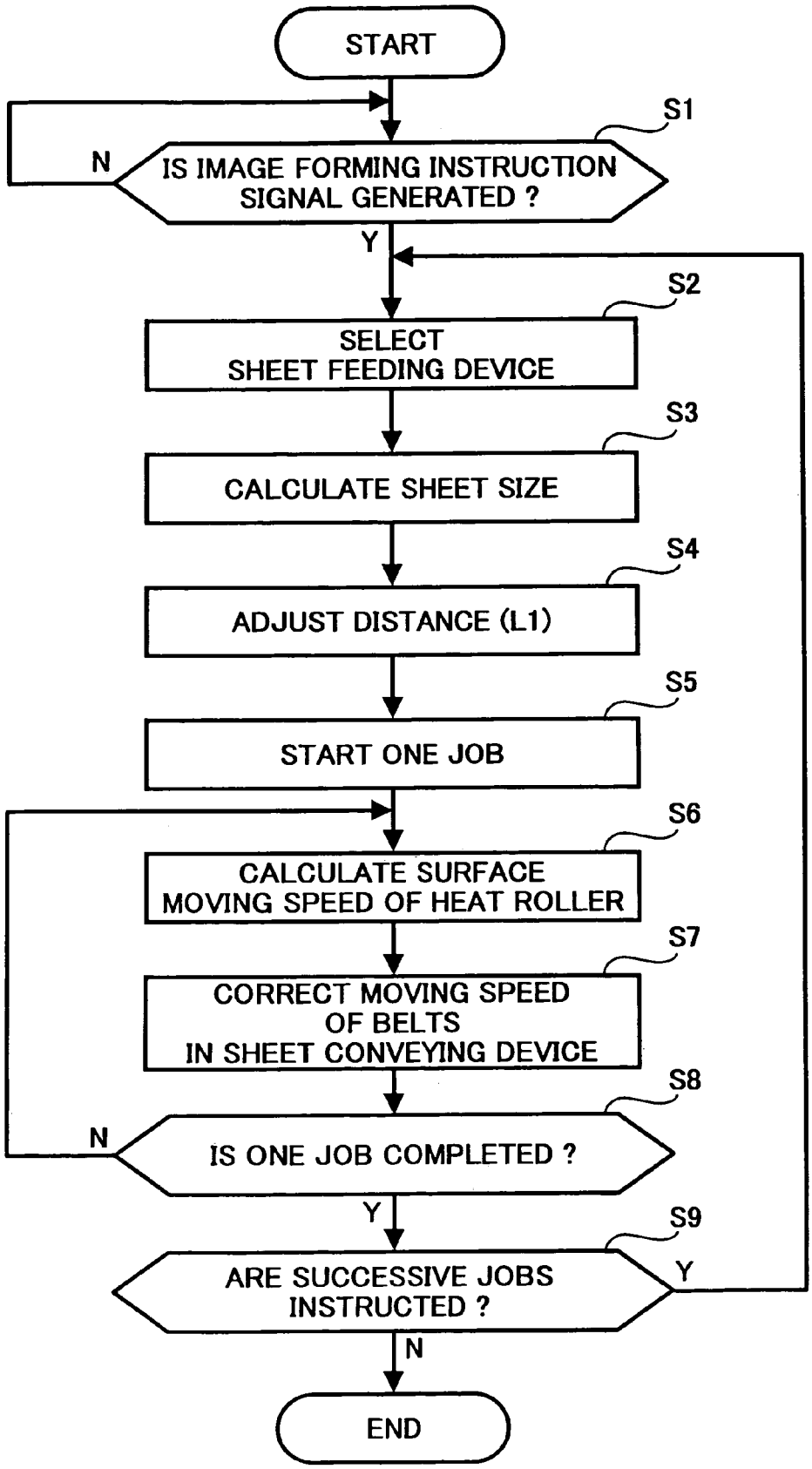
FIG. 12 is a flowchart illustrating steps of a control operation of a central processing unit (CPU) in the printer of FIG. 1.

FIG. 12 is a flowchart illustrating the control operation of the CPU (E2*a*). In step S1, the CPU (E2*a*) determines if an image forming instruction signal is generated from the personal computer 400. If the answer is YES in step S1, the CPU (E2*a*) selects a sheet feeding device from one of the sheet feeding cassette 26 and the manual sheet feeding tray (not shown) based on the image forming instruction signal in step S2. If the answer is NO in step S1, the control operation returns to re-execute step S1. Subsequently, the CPU (E2*a*) calculates a size of a transfer sheet P accommodated in (or set on) the selected sheet feeding device based on a signal output from the sheet size detecting sensor 61 in step S3. The CPU (E2*a*) adjusts the distance (L1) between the belts 101*a*, 101*b* and between the belts 201*a*, 201*b* to a distance corresponding to a width of the transfer sheet P by driving the motor (M2) in step S4, and starts one job for an image forming process in step S5.

During the one job, the CPU (E2*a*) calculates the surface moving speed of the heat roller 31 based on a detection result of the roller speed detecting sensor 62 in step S6, and corrects the rotation speed of the motor (M1) based on a calculation value of the CPU (E2*a*). By correcting the rotation speed of the motor (M1) based on the calculation value of the CPU (E2*a*), each moving speed of the belts 101*a*, 101*b*, 201*a*, 201*b* in the sheet conveying device 300 is corrected for matching with the surface moving speed of the heat roller 31 in step S7. Specifically, in the printer 600, the motor (M1) is controllably rotated so that each moving speed of the belts 101*a*, 101*b*, 201*a*, 201*b* in the sheet conveying device 300 substantially equals the surface moving speed of the heat roller 31 (i.e., the pressure roller 32 is rotated at substantially the same speed as the heat roller 31).

In step S8, the CPU (E2*a*) judges if the above-described one job is completed. If the answer is NO in step S8, the control operation returns to re-execute step S6. If the answer is YES in step S8, the CPU (E2*a*) judges if successive jobs for continuous printings are instructed in step S9. If the answer is YES in step S9, the control operation returns to re-execute step S2. If the answer is NO in step S9, the control operation ends.

In the heat fixing device 30, the heat roller 31 slightly expands and contracts due to the heating and radiation by the heater, resulting in an unevenness of the surface moving speed of the heat roller 31. In the printer 600 according to this embodiment of the present invention, when the surface moving speed of the heat roller 31 changes, each moving speed of the belts 101*a*, 101*b*, 201*a*, 201*b* in the sheet conveying device 300 is controlled to change following so as to be substantially equal to the surface moving speed of the heat roller 31. Thus, slack in a transfer sheet P between the sheet conveying device 300 and the heat fixing device 30 caused by the unevenness of the surface moving speed of the heat roller 31 can be obviated. Further, rubbing of a transfer sheet P in the heat fixing device 30 and the sheet conveying device 300 can be also prevented.

As described above, in the printer 600, the sheet size detecting sensor 61 detects the size of the transfer sheet P accommodated in the sheet feeding cassette 26 and set on the manual sheet feeding tray, and each distance (L1) between the belts 101*a*, 101*b* and between the belts 201*a*, 201*b* is automatically adjusted according to the detected size of the transfer sheet P. Therefore, the distance (L1) can be automatically adjusted according to various sizes of the transfer sheet P without causing an operator to be inconvenienced by manually adjusting the distance (L1) to the size of the transfer sheet P.

Further, in the printer 600, the distance (L1) can be adjusted based on operational instructions input to the operation panel 60 by an operator. Therefore, the operator can easily adjust the distance (L1) by inputting operational instructions to the operation panel 60 without opening the case of the main body of the printer 600 to operate the sheet conveying device 300 directly. Moreover, the distance (L1) can be adjusted based on a control signal transmitted to the printer 600 from the personal computer 400 located away from the printer 600.

As described above, the control device (E2) controls a sheet conveying speed of the belts 101*a*, 101*b*, 201*a*, and 201*b* in the sheet-conveying device 300. Further, the control device (E2) controls the distance changing mechanism that adjusts the distance (L1).

Figure 13:
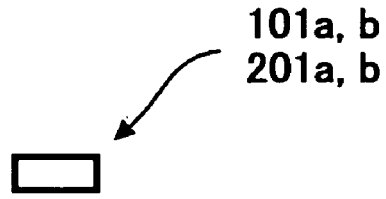
FIG. 13 is a transverse cross-sectional view of a flat type belt.

In the printer 600, a round type belt having a circle-shaped cross-section is used for the belts 101*a*, 101*b*, 201*a*, and 201*b*. The round type belt has an inclined peripheral surface that faces a transfer sheet P. An apex portion of the inclined peripheral surface of the round type belt contacts the transfer sheet P. As compared to a flat type belt having a rectangular cross section as illustrated in FIG. 13 and having a flat surface which contacts a transfer sheet, each contact area of the belts 101*a*, 101*b*, 201*a*, 201*b* and the transfer sheet P may be reduced in the round type belt. The reduction of the contact area of the belts 101*a*, 101*b*, 201*a*, 201*b* and the transfer sheet P decreases the possibility of contacting an unfixed toner image on the transfer sheet P with the belts 101*a*, 101*b*, 201*a*, 201*b*. As a result, blurring of an unfixed toner image due to the contact with the belts 101*a*, 101*b*, 201*a*, 201*b*, and degrading of succeeding transfer sheet P by the toner adhered onto the belts 101*a*, 101*b*, 201*a*, 201*b* due to the contact of an unfixed toner image with the belts can be effectively prevented. When a thickness of a round type belt is set to be substantially equal to that of a flat type belt, the round type belt may have a similar strength as the flat type belt.

Figure 14:
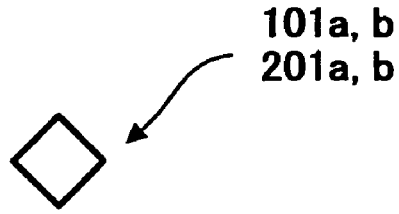
FIG. 14 is a transverse cross-sectional view of a diamond type belt.
Figure 15:
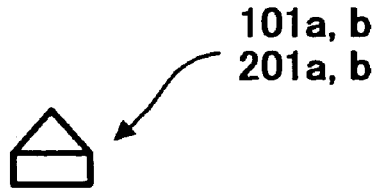
FIG. 15 is a transverse cross-sectional view of a belt including two layers formed from a flat type belt and a triangle type belt.

The examples of a belt with an inclined peripheral surface having an apex portion include the above-described round type belt, a diamond type belt having a diamond-shaped cross section as illustrated in FIG. 14, a triangle type belt having a triangle-shaped cross section, and a trapezoidal type belt having a trapezoid-shaped cross section. In addition, as illustrated in FIG. 15, a belt including two layers formed from a flat type belt and a triangle type belt may be employed.

FIG. 13 illustrates various sizes of flat type belts widely used in the market. Therefore, as compared to a belt of a special shape that is not widely used, the cost of an apparatus can be decreased by using a flat type belt.

Figure 16:
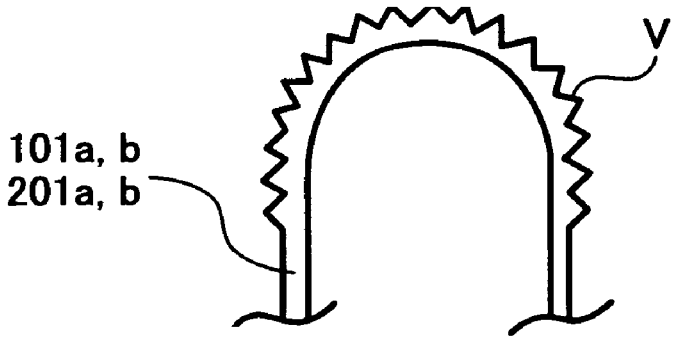
FIG. 16 is a vertical cross-sectional view of a caterpillar type belt.
Figure 17:
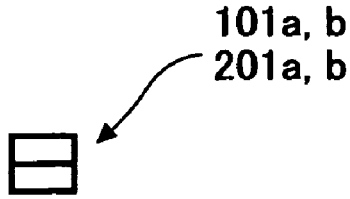
FIG. 17 is a transverse cross-sectional view of the caterpillar type belt of FIG. 16.

A caterpillar type belt, illustrated in FIG. 16, may be used as an alternative to a flat type belt and a belt including an inclined peripheral surface having an apex portion. The caterpillar type belt includes a plurality of rib-shaped protrusions that extend in a width direction of the belt on the front surface of the belt, and conveys a transfer sheet P by pressing the transfer sheet P between the protrusions. Thereby, the transfer sheet P is conveyed by being effectively held between the belts. Instead of a caterpillar type belt in which rib-shaped protrusions are integrally formed with a base substrate, another caterpillar type belt in which protrusions are independently formed on a base substrate may be employed. The cross section of such a caterpillar type belt is illustrated in FIG. 17. Further, so long as a belt has a plurality of protrusions on its surface, a similar effect as the caterpillar type belt can be obtained.

It is preferable to form the belts 101*a*, 101*b*, 201*a*, and 201*b* from heat-resisting materials having a glass transition point higher than 200° C., such that the heat-resisting material is not fused at 200° C. Further, the contraction percentage of the heat-resisting material under 200° C. is 0.5% or less. 200° C. is a fixing temperature generally employed in an image forming apparatus. Thus, the belts 101*a*, 101*b*, 201*a*, 201*b* are not damaged by heat generated from the heat roller 31 in the heat fixing device 30, and therefore the sheet conveying device 300 can be positioned close to the heat fixing device 30, such that the sheet conveying device 300 conveys a transfer sheet P to the heat fixing device 30. As an example of the heat-resisting material, polyimide may be employed.

Next, a printer according to an example will be described.

In the first belt pair unit 100 in the printer 600, as illustrated in FIG. 8, the side plates 108*a* and 108*b* are arranged in parallel with each other such that each distance (L1) between the belts 101*a*, 101*b* and between the belts 201*a*, 201*b* is uniform in a sheet conveying direction (i.e., irrespective of a position of a transfer sheet P conveyed in the sheet conveying device 300).

In the printer according to this example, both side plates are arranged such that a distance between belts at a sheet incoming side (i.e., at a driven pulley side) is greater than a distance between belts at a sheet outgoing side (i.e., at a drive pulley side). In this arrangement, even if a transfer sheet P slightly wanders in a width direction of the sheet conveying belt 10 (i.e., in a direction perpendicular to a sheet conveying direction) in the transfer unit 20, after the sheet conveying device 300 receives the transfer sheet P from the transfer unit 20, the sheet conveying device 300 conveys the transfer sheet P toward the heat fixing device 30 while correcting the position of the transfer sheet P in the sheet conveying device 300. Thus, the sheet conveying device 300 effectively receives the transfer sheet P from the transfer unit 20 and conveys the transfer sheet P to the heat fixing device 30.

Figure 18:
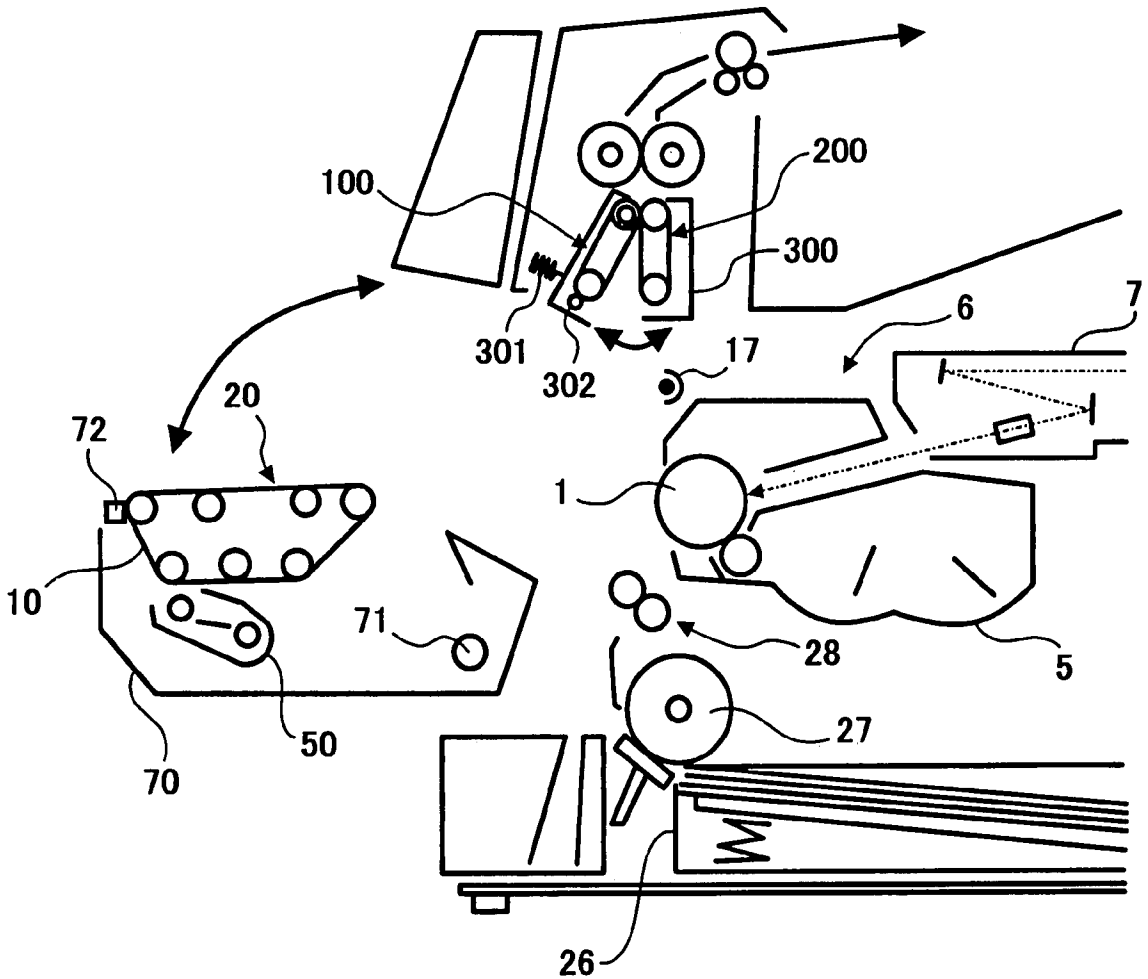
FIG. 18 is a schematic view illustrating a portion of a printer according to an example.

FIG. 18 is a schematic view illustrating a printer according to another example. The transfer unit 20 and the belt cleaning unit 50 in the two-side transfer device are fixed to an open/close door 70 of a main body of a printer. The open/close door 70 opens and closes by rotating about a rotation shaft 71. When the open/close door 70 is opened, the sheet conveying belt 10 supported by the open/close door 70 is moved away from the photosensitive drum 1 fixed in the main body of the printer. As a result, a sheet conveying path around the sheet conveying belt 10 is opened, and removal of a jammed sheet in the transfer unit 20 is facilitated.

Figure 19:
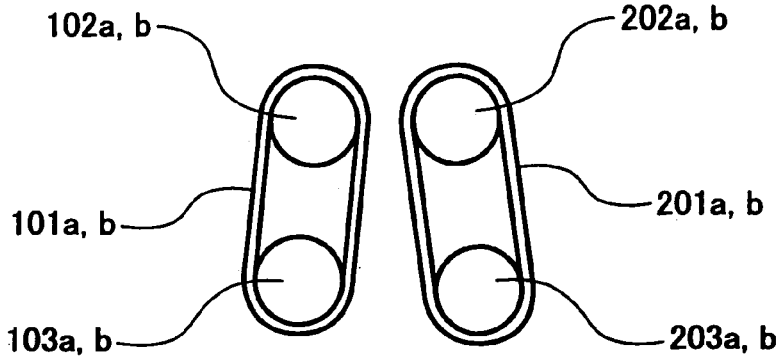
FIG. 19 is a side view of the sheet conveying device in which a first belt pair unit is separated from a second belt pair unit according to the example of FIG. 18.

Referring further to FIG. 18, the first belt pair unit 100 in the sheet conveying device 300 is constructed to swing around the drive pulley 102. One end of a spring 301 is connected to the first belt pair unit 100 on a driven pulley 103 side. The other end of the spring 301 is fixed to a rear side of the front panel of the printer. By a compression force of the spring 301, the lower side of the first belt pair unit 100 is moved toward the front panel. As a result, the first belt pair unit 100 swings leftward in FIG. 18 and separates from the second belt pair unit 200. As the first belt pair unit 100 is separated from the second belt pair unit 200, a sheet conveying path in the sheet conveying device 300 is opened as illustrated in FIG. 19, thereby facilitating removal of a jammed sheet in the sheet conveying device 300.

When the open/close door 70 is closed, a pin pressing member 72 fixed to the open/close door 70 biases a pin 302 fixed to the first belt pair unit 100 toward the second belt pair unit 200. The first belt pair unit 100 swings rightward in FIG. 18 and abuts the second belt pair unit 200. As described above, a moving mechanism that allows one of the belt pair units to be brought into contact with and separated from the other belt pair unit is constructed by the spring 301, the pin 302, the pin pressing member 72, the open/close door 70, the rotation shaft 71, etc.

When an operator opens the open/close door 70, a separating operation of the first belt pair unit 100 from the second belt pair unit 200, and an opening of a sheet conveying path in the two-side transfer device by moving the sheet conveying belt 10 are implemented at substantially the same time. With the above-described construction, by one operation of opening the open/close door 70, both sheet conveying paths in the two-side transfer device and the sheet conveying device 300 can be opened at one time. As a result, removal of a jammed sheet is facilitated.

Figure 20:
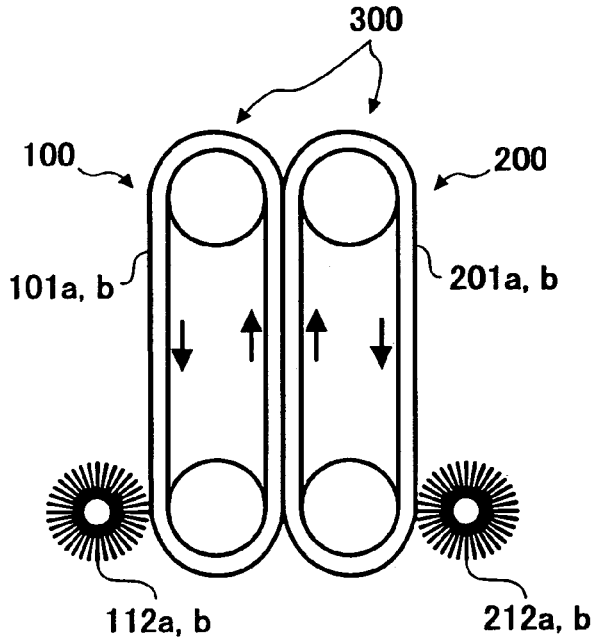
FIG. 20 is a schematic view of the sheet conveying device according to another example.

FIG. 20 is a schematic view of the sheet conveying device 300 according to another example. As illustrated in FIG. 20, the sheet conveying device 300 includes two pairs of cleaning devices downstream of contact portions of the belts in the first belt pair unit 100 and the belts in the second belt pair unit 200 in a moving direction of the belts. Specifically, one pair of cleaning brushes 112*a*, 112*b* respectively clean the belts 101*a*, 101*b* in the first belt pair unit 100. Further, the other pair of cleaning brushes 212*a*, 212*b* respectively clean the belts 201*a*, 201*b* in the second belt pair unit 200. In this construction, even if the belts 101*a*, 101*b*, 201*a*, 201*b* are degraded by the toner scattered in the main body of the printer 600 and by the toner of an unfixed toner image on the deflected transfer sheet P, the cleaning brushes 112*a*, 112*b*, 212*a*, 212*b* remove toner from the belts 101*a*, 101*b*, 201*a*, 201*b*, respectively. Therefore, a degradation of a succeeding transfer sheet P due to the above-described toner on the belts 101*a*, 101*b*, 201*a*, 201*b* can be obviated. In place of the-cleaning brushes 112*a*, 112*b*, 212*a*, 212*b* illustrated in FIG. 20, the cleaning device may be implemented by an electrostatic cleaning roller or a cleaning blade.

Figure 21:
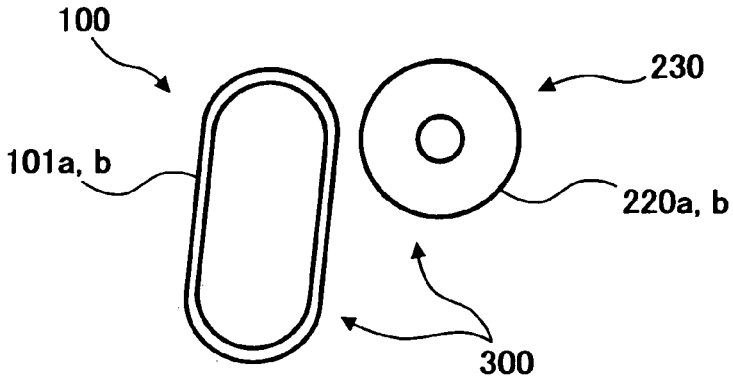
FIG. 21 is a schematic view of the sheet conveying device according to another example.

FIG. 21 is a schematic view of the sheet conveying device 300 according to another example. As illustrated in FIG. 21, the sheet conveying device 300 includes a disk pair unit 230 instead of the second belt pair unit 200. The disk pair unit 230 serving as a rotation body pair unit includes a pair of disks 220*a*, 220*b* instead of the belts 201*a*, 201*b*. The pair of disks 220*a*, 220*b* rotate in contact with the vicinities of both end portions of a transfer sheet P in a width direction. As compared to the belt pair unit requiring pulleys and gears for stretching and moving the belts, a structure of the disk pair unit 230 in which disks are rotated by use of shaft members, etc., may be more simple. However, the belt pair unit has an advantage that a long narrow layout can be designed as compared to the disk pair unit.

In the disk pair unit 230, a cleaning device like the cleaning brushes 212*a*, 212*b* illustrated in FIG. 20 may be provided with the disks 220*a*, 220*b*.

Further, the disks 220*a*, 220*b* may be formed from heat-resisting materials like the belts 101*a*, 101*b*, 201*a*, 201*b*. In this case, the belts 101*a*, 101*b* and the disks 220*a*, 220*b* do not suffer damage by heat generated from the heat roller 31 in the heat fixing device 30, so that the sheet conveying device 300 can be positioned close to the heat fixing device 30, and thereby the sheet conveying device 300 surely conveys a transfer sheet P to the heat fixing device 30.

Figure 22:
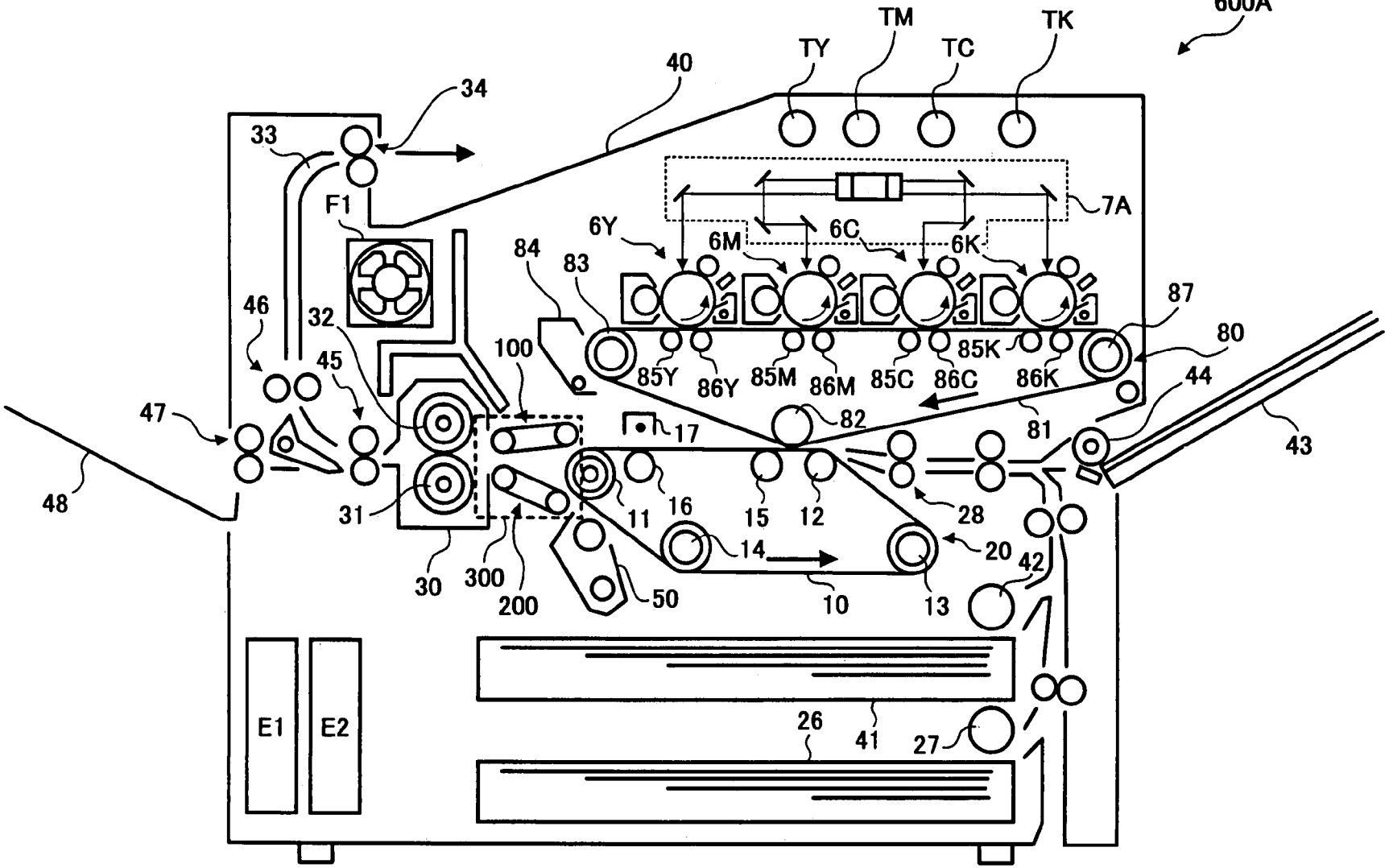
FIG. 22 is a schematic cross-sectional view of a printer according to another embodiment of the present invention.

FIG. 22 is a schematic cross-sectional view of a printer 600A according to another embodiment of the present invention. The construction of the printer 600A is similar to that of the printer 600 of FIG. 1, and therefore members having substantially the same functions as those used in the printer 600 of FIG. 1 are designated with the same reference characters and their description is omitted.

Referring to FIG. 22, the printer 600A includes four process cartridges 6Y, 6M, 6C, 6K, and a first transfer unit 80. The process cartridges 6Y, 6M, 6C, 6K, form a yellow toner image, a magenta toner image, a cyan toner image, and a black toner image, respectively. The constructions of the process cartridges 6Y, 6M, 6C, 6K are substantially the same except that the process cartridges 6Y, 6M, 6C, 6K form toner images of different colors. The construction of the process cartridge 6Y will be described as a representative example.

Figure 23:
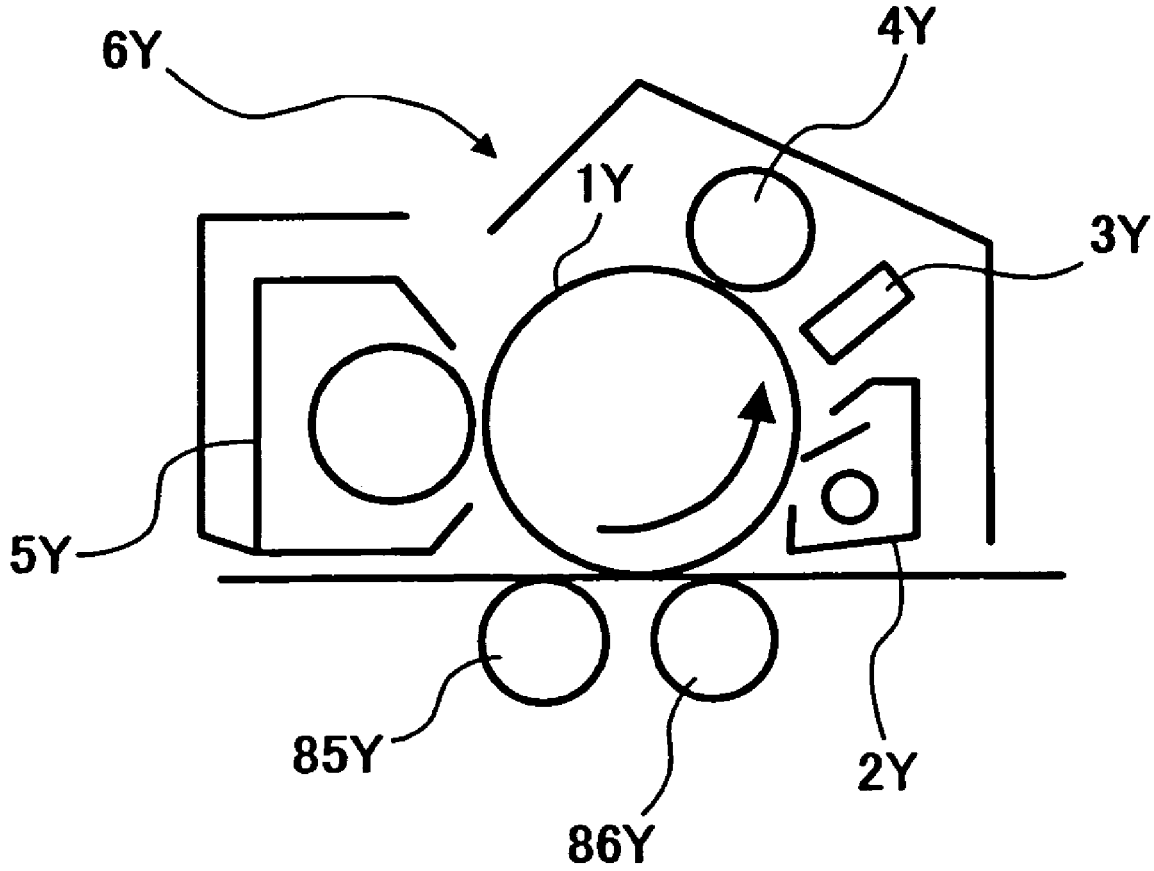
FIG. 23 is an enlarged view of a process cartridge for forming a yellow toner image in the printer of FIG. 22.

As illustrated in FIG. 23, the process cartridge 6Y includes a photosensitive drum 1Y, a drum cleaning device 2Y, a discharging device 3Y, a charging device 4Y, and a developing device 5Y. The charging device 4Y uniformly charges the surface of the photosensitive drum 1Y driven to rotate in a counter-clockwise direction indicated by the arrow on the photosensitive drum 1Y by a drive device (not shown). An exposure device 7A is configured to individually expose the photosensitive drums 1Y, 1M, 1C, 1K. For example, the exposure device 7A exposes the surface of the photosensitive drum 1Y uniformly charged by the charging device 3Y, thereby forming an electrostatic latent image for yellow. The electrostatic latent image for yellow is developed with yellow toner by the developing device 5Y, so that a yellow toner image is formed on the photosensitive drum 1Y. The yellow toner image formed on the photosensitive drum 1Y is transferred onto an intermediate transfer belt 81 in a first transfer unit 80 illustrated in FIG. 22.

The drum cleaning device 2Y removes a residual toner remaining on the photosensitive drum 1Y after the yellow toner image is transferred onto the intermediate transfer belt 81. The discharging device 3Y discharges the surface of the photosensitive drum 1Y after the cleaning by the drum cleaning device 2Y so as to remove a residual charge on the photosensitive drum 1Y for the preparation of subsequent image formation. In a similar manner, a magenta toner image, a cyan toner image, and a black toner image are respectively formed on the photosensitive drums 1M, 1C, 1K, and are transferred onto the intermediate transfer belt 81.

The first transfer unit 80 includes an endless-belt shaped intermediate transfer belt 81 spanning a drive roller 82, and driven rollers 83, 87. The first transfer unit 80 further includes intermediate transfer rollers 85Y, 85M, 85C, 85K, and back-up rollers 86Y, 86M, 86C, 86K which oppose the process cartridges 6Y, 6M, 6C, 6K, respectively. The intermediate transfer rollers 85Y, 85M, 85C, 85K and back-up rollers 86Y, 86M, 86C, 86K contact the photosensitive drums 1Y, 1M, 1C, 1K, respectively, via the intermediate transfer belt 81, thereby forming respective intermediate transfer nip parts for yellow, magenta, cyan, black toner images between the process cartridges 6Y, 6M, 6C, 6K and the first transfer unit 80. At the respective intermediate transfer nip parts, the intermediate transfer rollers 85Y, 85M, 85C, 85K, to which intermediate transfer bias is applied from a power supply (not shown), abut a rear surface of the intermediate transfer belt 81, thereby forming an intermediate transfer electric field. The intermediate transfer belt 81 is rotated in a clockwise direction indicated by the arrow on the intermediate transfer belt 81 by the drive roller 82 driven to rotate by a drive device (not shown).

The yellow toner image, the magenta toner image, the cyan toner image, and the black toner image formed on the photosensitive drums 1Y, 1M, 1C, 1K are sequentially transferred onto the intermediate transfer belt 81 by influence of the intermediate transfer bias applied to the intermediate transfer rollers 85Y, 85M, 85C, 85K at the respective intermediate transfer nip parts, and are superimposed on each other on the intermediate transfer belt 81. As a result, the superimposed four color toner image is formed on the intermediate transfer belt 81.

In addition, a secondary transfer nip part is formed by bringing a portion of the intermediate transfer belt 81 stretching at the drive roller 82 into contact with the sheet conveying belt 10 in the transfer unit 20. The superimposed four color toner image on the intermediate transfer belt 81 is transferred onto the sheet conveying belt 10 or a transfer sheet P at the same time at the secondary transfer nip part. The pair of registration rollers 28 feed the transfer sheet P at an appropriate timing such that the position of the transfer sheet P and the superimposed four color toner image on the intermediate transfer belt 81 correctly meet with each other at the secondary transfer nip part. If the superimposed four color toner image is a first side image to be transferred onto a rear surface of a transfer sheet P, the registration rollers 28 do not feed a transfer sheet P. Specifically, a first side image is transferred onto the sheet conveying belt 10 at the secondary transfer nip part, and a second side image is transferred onto a transfer sheet P.

At an upper part of the main body of the printer 600A, there are arranged toner containers (TY), (TM), (TC), (TK) that contain a yellow toner, a magenta toner, a cyan toner, a black toner, respectively to supply to the developing devices 5Y, 5M, 5C, 5K.

In this embodiment, a so-called tandem type image forming apparatus is described as the printer 600A that forms full color images on both sides of a transfer sheet P by use of the four process cartridges 6Y, 6M, 6C, 6K. Alternatively, the printer 600A may form full color images on both sides of a transfer sheet P by use of a single process cartridge. In this case, a revolver type developing device including four developing units containing a yellow toner, a magenta toner, a cyan toner, a black toner, is arranged at an opposite position to a photosensitive drum. Respective electrostatic latent images for yellow, magenta, cyan, and black individually formed on the single photosensitive drum are sequentially developed with corresponding color toner by the revolver type developing device. Yellow, magenta, cyan, and black toner images are sequentially transferred from the photosensitive drum to the intermediate transfer belt 81, and are superimposed on each other on the intermediate transfer belt 81. In this case, the superimposed four color toner image is formed on the intermediate transfer belt 81 while the intermediate transfer belt 81 is rotated at least four times. In the above-described printer 600A having a single process cartridge, the sheet conveying belt 10 needs to be separated from the intermediate transfer belt 81 until the superimposed four color toner image is obtained so as not to transfer a single color, two color, and three color toner image onto the sheet conveying belt 10.

Referring to FIG. 22, a two-side transfer device is constructed by the transfer unit 20, the belt cleaning unit 50, the transfer charger 17, and the first transfer unit 80. The two-side transfer device in this embodiment is positioned such that a transfer sheet P is conveyed in a substantially horizontal direction. At the left side of the two-side transfer device, the sheet conveying device 300 is provided. The sheet conveying device 300 is positioned such that a transfer sheet P is conveyed in a substantially horizontal direction, and conveys the transfer sheet P to the heat fixing device 30 provided at the left side of the sheet conveying device 300. Thus, the two-side transfer device including the transfer unit 20, the sheet conveying device 300, and the heat fixing device 30 are arranged in a substantially horizontal direction. In the printer 600A, space can be reduced by positioning the two-side transfer device, the sheet conveying device 300, and the heat fixing device 30 in a substantially horizontal direction. As a result, a space for a sheet feeding cassette 41 is obtained, in addition to the space provided for the sheet feeding cassette 26.

Further, by positioning the two-side transfer device such that a transfer sheet P is conveyed in a substantially horizontal direction, a sheet receiving position of the sheet conveying belt 10 can be placed close to a side surface of the main body of the printer 600A. Thereby, a transfer sheet P can be fed from a manual sheet feeding tray 43 that is opened and closed at the side surface of the main body of the printer 600A.

The transfer sheet P conveyed in the substantially horizontal direction from the transfer unit 20 to the heat fixing device 30 is conveyed to the sheet discharging path 33 via a pair of sheet conveying rollers 45, a guide member (not shown), and a pair of sheet conveying rollers 46. The guide member serves to change a moving direction of a transfer sheet P that has passed through the pair of sheet conveying rollers 45 from a substantially horizontal direction to a substantially vertical direction. The transfer sheet P is directed to the pair of sheet conveying rollers 46 in a substantially vertical direction by the guide member. When the pair of sheet conveying rollers 46 are rotated in a forward direction, the transfer sheet P is stacked on the A sheet discharging and stacking part 40, which is positioned at the top part of the main body of the printer 600A, after passing through the pair of sheet discharging rollers 34. When the pair of sheet conveying rollers 46 are switched to rotate in a reverse direction from a forward direction at a predetermined timing, the trailing edge of the transfer sheet P is directed to a pair of sheet discharging rollers 47, which is provided at a left lower side part of the main body of the printer 600A, by the guide member. Subsequently, the transfer sheet P is discharged on a stack tray 48.

Figure 24:
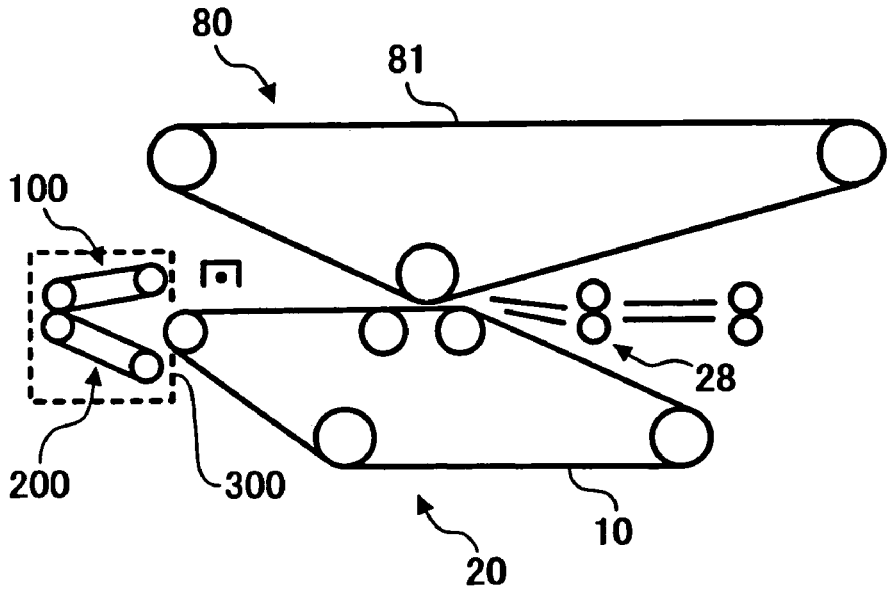
FIG. 24 is a schematic view of a two-side transfer device and a sheet conveying device in the printer of FIG. 22.

FIG. 24 is a schematic view of the two-side transfer device and the sheet conveying device 300. As illustrated in FIG. 24, the first belt pair unit 100 and the second belt pair unit 200 in the sheet conveying device 300 contact each other at a side where the sheet conveying device 300 conveys a transfer sheet P to the heat fixing device 30. The first belt pair unit 100 and the second belt pair unit 200 are separated from each other at a side where the sheet conveying device 300 receives a transfer sheet P from the transfer unit 20, thereby forming a wide sheet, receiving space in the sheet conveying device 300. With this construction, the transfer sheet P is received by the sheet conveying device 300 from the transfer unit 20 while being directed to between the first belt pair unit 100 and the second belt pair unit 200 and being sandwiched therebetween.

Further, in the printer 600A, as illustrated in FIG. 24, the end part of the transfer unit 20 is disposed in a part of the sheet conveying device 300 where the first belt pair unit 100 and the second belt pair unit 200 are separated from each other. In this construction, the leading edge portion of the transfer sheet P projected from the end part of the transfer unit 20 by rotation of the sheet conveying belt 10 can be surely positioned in the sheet conveying device 300. Thereby, the transfer sheet P is received by the sheet conveying device 300 from the transfer unit 20.

Figure 25:
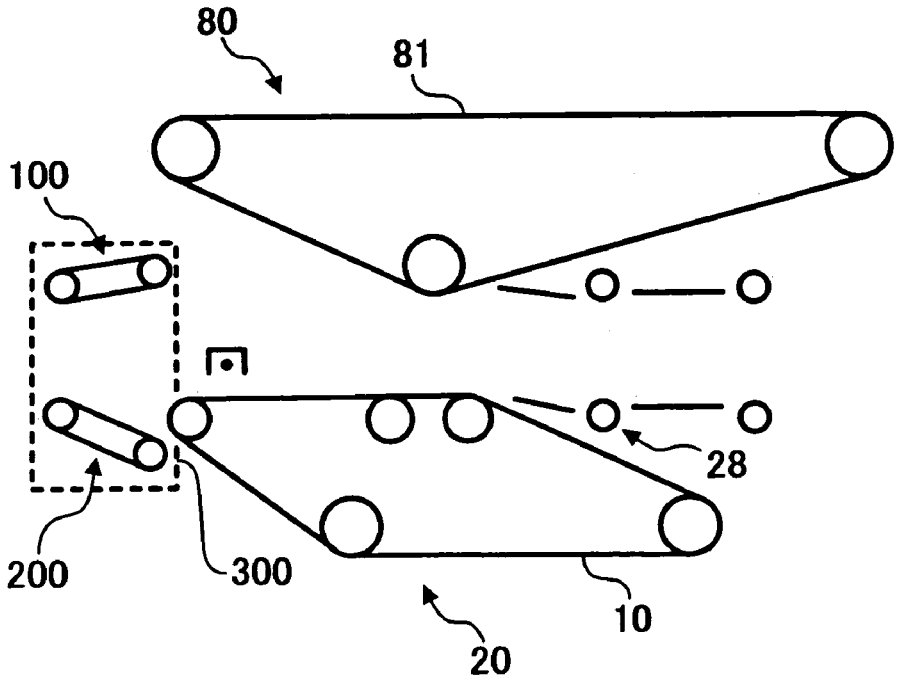
FIG. 25 is a schematic view of the two-side transfer device and the sheet conveying device which are divided into an upper part and a lower part, respectively.

As illustrated in FIG. 25, a case of the main body of the printer 600A is constructed so as to be opened such that the main body of the printer 600A is divided into an upper part and a lower part. By opening the case of the main body of the printer 600A, the first transfer unit 80 is separated from the transfer unit 20, and the first belt pair unit 100 is separated from the second belt pair unit 200 in the sheet conveying device 300. By these separations, a sheet conveying path between the first transfer unit 80 and the transfer unit 20, and a sheet conveying path in the sheet conveying device 300 are exposed to an exterior of the printer 600A, thereby facilitating removal of a jammed sheet.

The present invention has been described with respect to the embodiments and examples as illustrated in the figures. However, the present invention is not limited to the embodiments and may be practiced otherwise.

For example, when recording images on both sides of a transfer sheet P, instead of turning one rotation the sheet conveying belt 10 carrying thereupon a first side toner image, the sheet conveying belt 10 can be rotated in the reverse direction to convey the first side toner image to the transfer nip part. In this case, a mechanism can be used to allow the photosensitive drum 1 to separate from the sheet conveying belt 10.

Further, in the above embodiments, the image bearing member (i.e., the photosensitive drum) is a drum. However, the image bearing member can be a belt.

Further, as an alternative to the sheet conveying belt 10, a sheet conveying roller may be employed as a recording medium holding member.

The charging polarity of the photosensitive drums 1, 1(Y, M, C, and K) and the toner, and the polarity of the transfer voltage are examples and can be reversed.

Further, in the above embodiments, the exposure devices 7, 7A use a laser system. However, an LED system may be also used.

Furthermore, instead of a digital type printer, the present invention can be practiced in an analog type image forming apparatus using an analog type exposure device.

The present invention has been described with respect to the printers 600, 600A, as examples of image forming apparatuses. However, the present invention can be applied to other image forming apparatuses such as a copying machine, a facsimile machine, etc.

Further, when the image forming apparatuses according to the above embodiments are color image forming apparatuses, the order of forming images of respective colors and/or the arrangement of the developing devices for respective colors are not limited to the ones described above.

Figure 26:
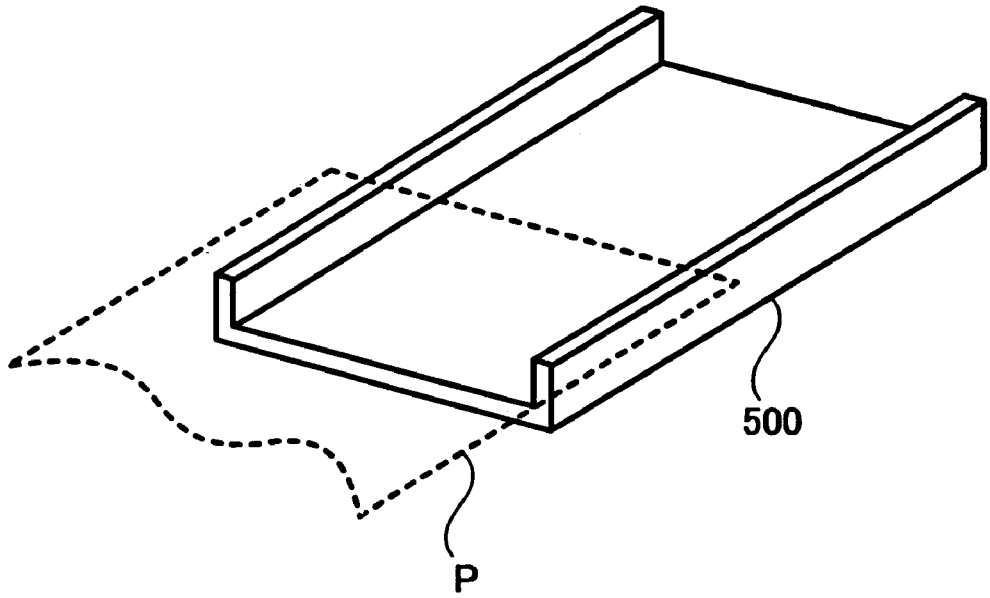
FIG. 26 is a perspective view of a both end guide member according to an alternative example.

As an alternative to the sheet conveying device 300 having a sheet conveying ability, a both end guide member illustrated in FIG. 26 may be used. Referring to FIG. 26, a both end guide member 500 supports both ends of a lower surface of a transfer sheet P conveyed from a two-side transfer device (not shown) in a substantially horizontal direction, and directs the transfer sheet P to a heat fixing device (not shown). The both end guide member 500 supports non-image portions of the transfer sheet P having toner images on both sides thereof, thereby directing the transfer sheet P to the heat fixing device without contacting an unfixed first toner image of the lower surface of the transfer sheet P. Therefore, blurring of an unfixed first toner image can be obviated. Further, by separating the two-side transfer device and the heat fixing device from each other, an image deterioration due to exposure to heat for fixing a toner image is prevented.

In the above-described both end guide member 500, non-image portions of a transfer sheet P need not be searched by a non-image portion detecting device that detects non-image portions of a transfer sheet P, and a mechanism for conveying forward a transfer sheet P whose leading and trailing edge portions are supported is not required. Thus, a transfer sheet P can be directed from the two-side transfer device to the heat fixing device by a more simple construction.

Figure 27:
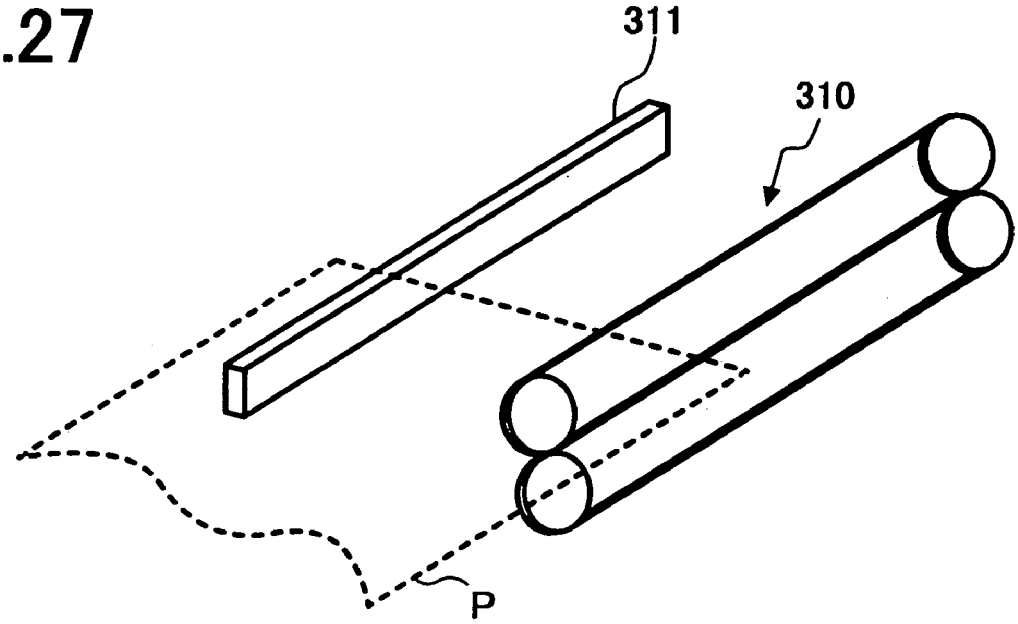
FIG. 27 is a perspective view of a sheet conveying device according to another alternative example.

As illustrated in FIG. 27, in place of the first and second belt pair units 100,200, the sheet conveying device 300 may include a one side belt unit pair 310 having a pair of belts that move and hold one end of a transfer sheet P by sandwiching the one end of the transfer sheet P therebetween, and a one end guide member 311 that supports the other end of the lower surface (i.e., one side) of the transfer sheet P. As compared to the sheet conveying device 300 including the first and second belt pair units 100, 200, the transfer sheet P is conveyed from the transfer unit 20 to the heat fixing device 30 by a more simple construction. Further, a transfer sheet P is prevented from dropping due to the influence of gravity, and a position of the transfer sheet P is prevented from being displaced.

According to the above-described embodiments and examples, by use of the sheet conveying device 300 in the printers 600, 600A, blurring of an unfixed first toner image due to contact by recording medium supporting members (i.e., the belts 101*a*, 101*b*, 201*a*, 201*b*) can be obviated. Further, by separating the two-side transfer device including the transfer unit 20 and the heat fixing device 30 from each other, an image deterioration due to exposure to heat generated from the heat fixing device 30 is prevented. Moreover, because a transfer sheet P is effectively conveyed from the transfer unit 20 to the heat fixing device 30 through the sheet conveying device 300, jamming of a sheet can be prevented. Thus, a high quality image can be formed in the printers 600 and 600A.

Numerous additional modifications and variations of the present invention are possible in light of the above teachings. It is therefore to be understood that within the scope of the appended claims, the present invention may be practiced otherwise than as specifically described herein.

The invention claimed is:

1. A recording medium conveying device for use in an image forming apparatus including image bearing members configured to bear visual images, visual image forming devices configured to form the visual images on the image bearing members, a two-side transfer device configured to transfer the visual images on the image bearing members onto both sides of a recording medium held on a recording medium holding member, at least two of the image bearing members disposed adjacent one another on a same side of the two-side transfer device, the recording medium holding member configured to move in a predetermined direction, and a fixing device configured to fix the visual images transferred onto the both sides of the recording medium, the conveying device comprising:

at least one recording medium supporting member configured to support the recording medium, wherein the recording medium conveying device is positioned at a recording medium conveying path between the two-side transfer device and the fixing device, the recording medium conveying device configured to convey the recording medium from the two-side transfer device to the fixing device while supporting a non-image portion of the recording medium by the at least one recording medium supporting member.

2. The recording medium conveying device according to claim 1, wherein the at least one recording medium supporting member comprises four recording medium supporting members, and wherein the four recording medium supporting members are configured to support first and second end portions of the recording medium such that first and third recording medium supporting members sandwich the first end portion of the recording medium therebetween and second and fourth recording medium supporting members sandwich the second end portion of the recording medium therebetween.

3. The recording medium conveying device according to claim 2, further comprising:

a first belt pair unit comprising first and second belts, wherein the first recording medium supporting member includes the first belt that is configured to move in contact with the first end portion at a first side of the recording medium, and the second recording medium supporting member includes the second belt that is configured to move in contact with the second end portion at the first side of the recording medium; and a second belt pair unit comprising third and fourth belts, wherein the third recording medium supporting member includes the third belt that is configured to move in contact with the first end portion at a second side of the recording medium, and the fourth recording medium supporting member includes the fourth belt that is configured to move in contact with the second end portion at the second side of the recording medium, wherein the first belt and the third belt are configured to sandwich the first end portion at the first and second sides of the recording medium therebetween, and the second belt and the fourth belt are configured to sandwich the second end portion at the first and second sides of the recording medium therebetween.

4. The recording medium conveying device according to claim 3, further comprising:

a moving mechanism configured to move the first belt pair unit into contact with and separate from the second belt pair unit.

5. The recording medium conveying device according to claim 3, further comprising:

a distance changing mechanism configured to change a distance between the first belt and the third belt at positions configured to correspond to the first end portion at the first and second sides of the recording medium sandwiched therebetween and the second belt and the fourth belt at positions configured to correspond to the second end portion at the first and second sides of the recording medium sandwiched therebetween.

6. The recording medium conveying device according to claim 3, wherein each of a length between the first and second belts and a length between the third and fourth belts in a direction perpendicular to a conveying direction of the recording medium at a side where the recording medium conveying device is configured to receive the recording medium from the two-side transfer device is greater than respective lengths at a side where the recording medium conveying device is configured to convey the recording medium to the fixing device.

7. The recording medium conveying device according to claim 3, wherein the first belt pair unit and the second belt pair unit are configured to separate from each other at a side where the recording medium conveying device is configured to receive the recording medium from the two-side transfer device, and the first belt pair unit and the second belt pair unit are configured to contact each other at a side where the recording medium conveying device conveys the recording medium to the fixing device.

8. The recording medium conveying device according to claim 3, wherein each of the first through fourth belts comprises a flat surface configured to contact the recording medium.

9. The recording medium conveying device according to claim 3, wherein each of the first through fourth belts comprises an inclined peripheral surface having an apex portion configured to contact the recording medium.

10. The recording medium conveying device according to claim 3, wherein each of the first through fourth belts comprises a plurality of protrusions configured to contact the recording medium.

11. The recording medium conveying device according to claim 2, further comprising:

a belt pair unit having first and second belts, wherein the first recording-medium supporting member includes the first belt that is configured to move in contact with the first end portion at a first side of the recording medium, and the second recording medium supporting member includes the second belt that is configured to move in contact with the second end portion at the first side of the recording medium; and a rotation body pair unit having first and second rotation bodies, wherein the third recording medium supporting member includes the first rotation body that is configured to rotate in contact with the first portion at a second side of the recording medium, and the fourth recording medium supporting member includes the second rotation body that is configured to rotate in contact with the second end portion of the second side at the recording medium, wherein first belt and the first rotation body are configured to sandwich the first end portion at the first and second sides of the recording medium therebetween, and the second belt and the second rotation body are configured to sandwich the second end portion at the first and second sides of the recording medium therebetween.

12. The recording medium conveying device according to claim 11, further comprising:

a moving mechanism configured to move one of the belt pair unit and the rotation body pair unit into contact with and separate from the other one of the belt pair unit and the rotation body pair unit.

13. The recording medium conveying device according to claim 11, further comprising:

a distance changing mechanism configured to change a distance between the first belt and the first rotation body at positions configured to correspond to the first end portion at the first and second sides of the recording medium sandwiched therebetween and the second belt and the second rotation body at positions configured to correspond to the second end portion at the first and second sides of the recording medium sandwiched therebetween.

14. The recording medium conveying device according to claim 11, wherein each of a length between the first and second belts and a length between the first and second rotation bodies in a direction perpendicular to a conveying direction of the recording medium at a side where the recording medium conveying device is configured to receive the recording medium from the two-side transfer device is greater than respective lengths at a side where the recording medium conveying device is configured to convey the recording medium to the fixing device.

15. The recording medium conveying device according to claim 11, wherein the belt pair unit and the rotation body pair unit are configured to separate from each other at a side where the recording medium conveying device is configured to receive the recording medium from the two-side transfer device, and the belt pair unit and the rotation body pair unit are configured to contact each other at a side where the recording medium conveying device is configured to convey the recording medium to the fixing device.

16. The recording medium conveying device according to claim 11, wherein each of the first and second belts comprises a flat surface configured to contact the recording medium.

17. The recording medium conveying device according to claim 11, wherein each of the first and second belts comprises an inclined peripheral surface including an apex portion configured to contact the recording medium.

18. The recording medium conveying device according to claim 11, wherein each of the first and second belts comprises a plurality of protrusions configured to contact the recording medium.

19. The recording medium conveying device according to claim 1, wherein the at least one recording medium supporting member comprises three recording medium supporting members, and wherein first and second recording medium supporting members are configured to respectively support the first end portion at first and second sides of the recording medium in a direction perpendicular to a conveying direction of the recording medium by sandwiching the first end portion at the first and second sides of the recording medium between the first and second recording medium supporting members, and a third recording medium supporting member is configured to support the second end portion at one of the first and second sides of the recording medium in the direction perpendicular to the conveying direction of the recording medium.

20. An image forming apparatus, comprising:

image bearing members configured to bear visual images;

visual image forming devices configured to form the visual images on the image bearing members;

a two-side transfer device comprising a recording medium holding member configured to hold a recording medium thereon, the two-side transfer device configured to transfer the visual images on the image bearing members onto both sides of the recording medium on the recording medium holding member while moving the recording medium holding member in a predetermined direction;

a fixing device configured to fix the visual images transferred onto the both sides of the recording medium; and a recording medium conveying device configured to convey the recording medium from the two-side transfer device to the fixing device, the recording medium conveying device comprising at least one recording medium supporting member configured to support the recording medium, wherein the recording medium conveying device is positioned at a recording medium conveying path between the two-side transfer device and the fixing device, the recording medium conveying device configured to convey the recording medium from the two-side transfer device to the fixing device while supporting a non-image portion of the recording medium by the at least one recording medium supporting member, and wherein at least two of the image bearing members are disposed adjacent one another on a same side of the two-side transfer device.

21. The image forming apparatus according to claim 20, wherein the at least one recording medium supporting member comprises four recording medium supporting members, and wherein the four recording medium supporting members are configured to support first and second end portions of the recording medium such that first and third recording medium supporting members sandwich the first end portion of the recording medium therebetween and second and fourth recording medium supporting members sandwich the second end portion of the recording medium therebetween.

22. The image forming apparatus according to claim 21, wherein the recording medium conveying device comprises:

a first belt pair unit having first and second belts, wherein the first recording medium supporting member includes the first belt that is configured to move in contact with the first end portion at a first side of the recording medium, and the second recording medium supporting member includes the second belt that is configured to move in contact with the second end portion at the first side of the recording medium; and a second belt pair unit having third and fourth belts, wherein the third recording medium supporting member includes the third belt that is configured to move in contact with the first end portion at a second side of the recording medium, and the fourth recording medium supporting member includes the fourth belt that is configured to move in contact with the second end portion at the second side of the recording medium, wherein the first belt and the third belt are configured to sandwich the first end portion at the first and second sides of the recording medium therebetween, and the second belt and the fourth belt are configured to sandwich the second end portion at the first and second sides of the recording medium therebetween.

23. The image forming apparatus according to claim 22, wherein the recording medium conveying device comprises a moving mechanism configured to move the first belt pair unit into contact with and separate from the second belt pair unit.

24. The image forming apparatus according to claim 22, wherein the recording medium conveying device comprises a distance changing mechanism configured to change a distance between the first belt and the third belt at positions configured to correspond to the first end portion at the first and second sides of the recording medium sandwiched therebetween and the second belt and the fourth belt at positions configured to correspond to the second end portion at the first and second sides of the recording medium sandwiched therebetween.

25. The image forming apparatus according to claim 22, wherein each of a length between the first and second belts and a length between the third and fourth belts in a direction perpendicular to a conveying direction of the recording medium at a side where the recording medium conveying device is configured to receive the recording medium from the two-side transfer device is greater than respective lengths at a side where the recording medium conveying device is configured to convey the recording medium to the fixing device.

26. The image forming apparatus according to claim 22, wherein the first belt pair unit and the second belt pair unit are configured to separate from each other at a side where the recording medium conveying device is configured to receive the recording medium from the two-side transfer device, and the first belt pair unit and the second belt pair unit are configured to contact each other at a side where the recording medium conveying device is configured to convey the recording medium to the fixing device.

27. The image forming apparatus according to claim 22, wherein each of the first through fourth belts comprises a flat surface configured to contact the recording medium.

28. The image forming apparatus according to claim 22, wherein each of the first through fourth belts comprises an inclined peripheral surface having an apex portion configured to contact the recording medium.

29. The image forming apparatus according to claim 22, wherein each of the first through fourth belts comprises a plurality of protrusions configured to contact the recording medium.

30. The image forming apparatus according to claim 21, wherein the recording medium conveying device comprises:

a belt pair unit having first and second belts, wherein the first recording medium supporting member includes the first belt that is configured to move in contact with first end portion at a first side of the recording medium, and the second recording medium supporting member includes the second belt that is configured to move in contact with the second end portion at the first side of the recording medium; and a rotation body pair unit having first and second rotation bodies, wherein the third recording medium supporting member includes the first rotation body that is configured to rotate in contact with the first end portion at a second side of the recording medium, and the fourth recording medium supporting member includes the second rotation body that is configured to rotate in contact with the second end portion at the second side of the recording medium, wherein the first belt and the first rotation body are configured to sandwich the first end portion at the first and second sides of the recording medium therebetween, and the second belt and the second rotation body are configured to sandwich the second end portion at the first and second sides of the recording medium therebetween.

31. The image forming apparatus according to claim 30, wherein the recording medium conveying device comprises a moving mechanism configured to move one of the belt pair unit and the rotation body pair unit into contact with and separate from the other one of the belt pair unit and the rotation body pair unit.

32. The image forming apparatus according to claim 30, wherein the recording medium conveying device comprises a distance changing mechanism configured to change a distance between the first belt and the first rotation body at positions configured to correspond to the first end portion at the first and second sides of the recording medium sandwiched there between and the second belt and the second rotation body at positions configured to correspond to the second end portion at the first and second sides of the recording medium sandwiched therebetween.

33. The image forming apparatus according to claim 30, wherein each of a length between the first and second belts and a length between the first and second rotation bodies in a direction perpendicular to a conveying direction of the recording medium at a side where the recording medium conveying device is configured to receive the recording medium from the two-side transfer device is greater than respective lengths at a side where the recording medium conveying device is configured to convey the recording medium to the fixing device.

34. The image forming apparatus according to claim 30, wherein the belt pair unit and the rotation body pair unit are configured to separate from each other at a side where the recording medium conveying device is configured to receive the recording medium from the two-side transfer device, and the belt pair unit and the rotation body pair unit are configured to contact each other at a side where the recording medium conveying device is configured to convey the recording medium to the fixing device.

35. The image forming apparatus according to claim 30, wherein each of the first and second belts comprises a flat surface configured to contact the recording medium.

36. The image forming apparatus according to claim 30, wherein each of the first and second belts comprises an inclined peripheral surface having an apex portion configured to contact the recording medium.

37. The image forming apparatus according to claim 30, wherein each of the first and second belts comprises a plurality of protrusions configured to contact the recording medium.

38. The image forming apparatus according to claim 20, wherein the at least one recording medium supporting member comprises three recording medium supporting members, and wherein first and second recording medium supporting members are configured to support the first end portion at first and second sides of the recording medium in a direction perpendicular to a conveying direction of the recording medium by sandwiching the first end portion at the first and second sides of the recording medium between the first and second recording medium supporting members, and a third recording medium supporting member is configured to support the second end portion at one of the first and second sides of the recording medium in the direction perpendicular to the conveying direction of the recording medium.

39. The image forming apparatus according to claim 20, further comprising:

at least one cleaning device configured to clean the at least one recording medium supporting member.

40. The image forming apparatus according to claim 20, further comprising:

a drive device configured to drive the at least one recording medium supporting member.

41. The image forming apparatus according to claim 20, wherein the fixing device includes a heat conveying member configured to convey the recording medium while heating, and wherein the image forming apparatus further comprises:

a speed detecting device configured to detect a surface moving speed of the heat conveying member; and a control device configured to control a recording medium conveying speed of the at least one recording medium supporting member based on a detection output of the speed detecting device.

42. The image forming apparatus according to claim 20, wherein the image bearing members are configured to bear visual images of different colors.

43. The image forming apparatus according to claim 21, wherein the recording medium conveying device is configured to convey the recording medium from a lower side to an upper side of the apparatus in a substantially vertical direction.

44. The image forming apparatus according to claim 21, wherein the recording medium conveying device is configured to convey the recording medium in a substantially horizontal direction.

45. The image forming apparatus according to claim 41, wherein the control device is configured to control the recording medium conveying speed of the at least one recording medium supporting member to be substantially the same as the surface moving speed of the heat conveying member.

46. The image forming apparatus according to claim 22, wherein the fixing device comprises a heat conveying member configured to convey the recording medium while heating, and wherein each of the first through fourth belts is configured to resist heat transferred from the fixing device.

47. The image forming apparatus according to claim 23, wherein the fixing device comprises a heat conveying member configured to convey the recording medium while heating, and wherein each of the first and second belts and the first and second rotation bodies is configured to resist heat transferred from the fixing device.

48. The image forming apparatus according to claim 26, further comprising:

a recording medium accommodating device configured to accommodate the recording medium to feed the recording medium to the two-side transfer device;

a size detecting device configured to detect a size of the recording medium accommodated in the recording medium accommodating device; and a control device configured to control the distance changing mechanism based on a detection output of the size detecting device.

49. The image forming apparatus according to claim 24, further comprising:

an operation part configured to receive an operational instruction; and a control device configured to control the distance changing mechanism based on the operational instruction received by the operation part.

50. The image forming apparatus according to claim 24, further comprising:

a control device configured to control the distance changing mechanism based on a control signal received from a computer.

51. The image forming apparatus according to claim 32, further comprising:

a recording medium accommodating device configured to accommodate the recording medium to feed the recording medium to the two-side transfer device;

a size detecting device configured to detect a size of the recording medium accommodated in the recording medium accommodating device; and a control device configured to control the distance changing mechanism based on a detection output of the size detecting device.

52. The image forming apparatus according to claim 32, further comprising:

an operation part configured to receive an operational instruction; and a control device configured to control the distance changing mechanism based on the operational instruction received by the operation part.

53. The image forming apparatus according to claim 32, further comprising:

a control device configured to control the distance changing mechanism based on a control signal received from a computer.

54. The image forming apparatus according to claim 23, wherein the moving mechanism is configured to move the recording medium holding member of the two-side transfer device at a substantially same time when the moving mechanism moves the first belt pair unit into contact with and separate from the second belt pair unit.

55. The image forming apparatus according to claim 31, wherein the moving mechanism is configured to move the recording medium holding member of the two-side transfer device at a substantially same time when the moving mechanism moves one of the belt pair unit and the rotation body pair unit into contact with and separate from the other one of the belt pair unit and the rotation body pair unit.

56. The image forming apparatus according to claim 26, wherein portions of at least one of the first and second belt pair units are disposed adjacent at least one of upper and lower portions of the two-side transfer device.

57. The image forming apparatus according to claim 34, wherein portions of at least one of the belt pair unit and the rotation body pair unit are disposed adjacent at least one of upper and lower portions of the two-side transfer device.

58. An image forming system, comprising:

an image forming apparatus according to claim 20; and a computer configured to send a control signal to the image forming apparatus.

59. A method of forming an image, comprising steps of:

forming visual images on image bearing members, at least two of the image bearing members disposed adjacent one another on a same side of a two-side transfer device;

transferring the visual images on the image bearing members onto both sides of a recording medium with the two-side transfer device while moving a recording medium holding member configured to holding the recording medium thereon in a predetermined direction;

conveying the recording medium having transferred visual images on the both sides to a fixing device configured to fix the visual images onto the recording medium while supporting a non-image portion of the recording medium; and fixing the visual images onto the recording medium.

60. An image forming apparatus, comprising:

means for bearing visual images;

means for forming the visual images on the bearing means;

means for transferring the visual images on the bearing means onto both sides of a recording medium on means for holding the recording medium while moving in a predetermined direction;

means for fixing the visual images transferred onto the both sides of the recording medium; and means for conveying the recording medium from the means for transferring to the means for fixing, the means for conveying comprising means for supporting the recording medium, wherein the means for conveying is positioned at a recording medium conveying path between the means for transferring and the means for fixing, the means for conveying supporting a non-image portion of the recording medium by the means for supporting, and wherein the means for bearing visual images comprises a plurality of image bearing members, at least two of the image bearing members disposed adjacent one another on a same side of the means for transferring visual images.

61. At least one recording medium supporting member for use in an image forming apparatus including image bearing members configured to bear visual images, visual image forming devices configured to form the visual images on the image bearing members, a two-side transfer device configured to transfer the visual images on the image bearing members onto both sides of a recording medium held on a recording medium holding member, at least two of the image bearing members disposed adjacent one another on a same side of the two-side transfer device, the recording medium holding member configured to move in a predetermined direction, and a fixing device configured to fix the visual images transferred onto the both sides of the recording medium, wherein the at least one recording medium supporting member is configured to support the recording medium in a recording medium conveying path between the two-side transfer device and the fixing device by contacting a non-image portion of the recording medium.

62. The at least one recording medium supporting member according to claim 61, wherein the at least one recording medium supporting member is configured to support both end portions of the recording medium in a direction perpendicular to a conveying direction of the recording medium.

* * * * *